US011730233B2

(12) United States Patent
Langvin et al.

(10) Patent No.: US 11,730,233 B2
(45) Date of Patent: Aug. 22, 2023

(54) SOLE STRUCTURE FOR ARTICLE OF FOOTWEAR

(71) Applicant: NIKE, Inc., Beaverton, OR (US)

(72) Inventors: Elizabeth Langvin, Sherwood, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 30 days.

(21) Appl. No.: 16/886,963

(22) Filed: May 29, 2020

(65) Prior Publication Data

US 2020/0375308 A1 Dec. 3, 2020

Related U.S. Application Data

(60) Provisional application No. 62/854,520, filed on May 30, 2019.

(51) Int. Cl.
*A43B 13/20* (2006.01)
*A43B 13/18* (2006.01)
*A43B 13/12* (2006.01)

(52) U.S. Cl.
CPC ..... *A43B 13/20* (2013.01); *A43B 13/187* (2013.01); *A43B 13/12* (2013.01)

(58) Field of Classification Search
CPC ..... A43B 7/1405; A43B 7/148; A43B 7/149; A43B 13/12; A43B 13/125; A43B 13/127; A43B 13/187; A43B 13/188; A43B 13/20; A43B 13/206; A43B 13/186; A43B 13/203; A43B 17/03; A43B 17/035; A43B 21/28; A43B 21/285
USPC ..... 36/29, 43, 71, 28, 35 B, 153
See application file for complete search history.

(56) References Cited

U.S. PATENT DOCUMENTS 5,367,791 A * 11/1994 Gross ..... A43B 13/26 36/31
5,469,639 A * 11/1995 Sessa ..... A43B 13/181 36/28
5,713,141 A 2/1998 Mitchell et al.
5,952,065 A 9/1999 Mitchell et al.
6,374,514 B1 * 4/2002 Swigart ..... A43B 13/20 36/35 B
6,582,786 B1 6/2003 Bonk et al.
8,650,775 B2 2/2014 Peyton
8,782,924 B2 * 7/2014 Peyton ..... A43B 13/122 36/35 B
10,172,420 B2 1/2019 James
(Continued)

OTHER PUBLICATIONS

Taiwan Patent Office, Office Action for Application No. 109118337 dated Jun. 3, 2021.

(Continued)

*Primary Examiner* — Heather Mangine
*Assistant Examiner* — Matthew R Marchewka
(74) *Attorney, Agent, or Firm* — Honigman LLP; Matthew H. Szalach; Jonathan P. O'Brien

(57) ABSTRACT

A sole structure for an article of footwear includes a bladder and at least one foam insert. The bladder includes an upper surface having a first portion defining a chamber and a second portion defining at least one recess adjacent to the chamber. The at least one foam insert is disposed within the at least one recess and has a top surface that is substantially flush with the first portion of the upper surface of the bladder. The first portion of the upper surface is exposed to the at least one foam insert.

20 Claims, 16 Drawing Sheets

(56) References Cited

U.S. PATENT DOCUMENTS

| | | | | |
|---|---|---|---|---|
| 2001/0045028 | A1* | 11/2001 | Crane | A43B 7/1415 36/43 |
| 2005/0132607 | A1 | 6/2005 | Dojan et al. | |
| 2007/0022630 | A1* | 2/2007 | Lundy | A43B 13/386 36/43 |
| 2009/0151196 | A1* | 6/2009 | Schindler | A43B 13/20 36/35 B |
| 2011/0005101 | A1* | 1/2011 | Sills | A43B 13/20 36/29 |
| 2015/0223564 | A1* | 8/2015 | Peyton | A43B 13/18 36/28 |
| 2017/0172250 | A1 | 6/2017 | Dolan et al. | |
| 2017/0265566 | A1 | 9/2017 | Case et al. | |
| 2018/0338577 | A1 | 11/2018 | Elder et al. | |
| 2020/0113281 | A1* | 4/2020 | Dirsa | A43B 13/184 |

OTHER PUBLICATIONS

European Patent Office (ISA), International Search Report and Written Opinion for PCT Application No. PCT/US2020/035055, dated Sep. 16, 2020.

Taiwan Patent Office, Office Action for Application No. 109118337 dated Nov. 21, 2022.

* cited by examiner 10
100
104
114
116
106
102, 112
200
202
208
264
262
260
208a
260a
262a
246a
206
216
218
204
30

SOLE STRUCTURE FOR ARTICLE OF FOOTWEAR

CROSS REFERENCE TO RELATED APPLICATION

This non-provisional U.S. Patent Application claims priority under 35 U.S.C. § 119(e) to U.S. Provisional Patent Application Ser. No. 62/854,520, filed May 30, 2019, the disclosure of which is hereby incorporated by reference in its entirety.

FIELD

The present disclosure relates generally to sole structures for articles of footwear and more particularly to sole structures incorporating a fluid-filled bladder having foam inserts.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
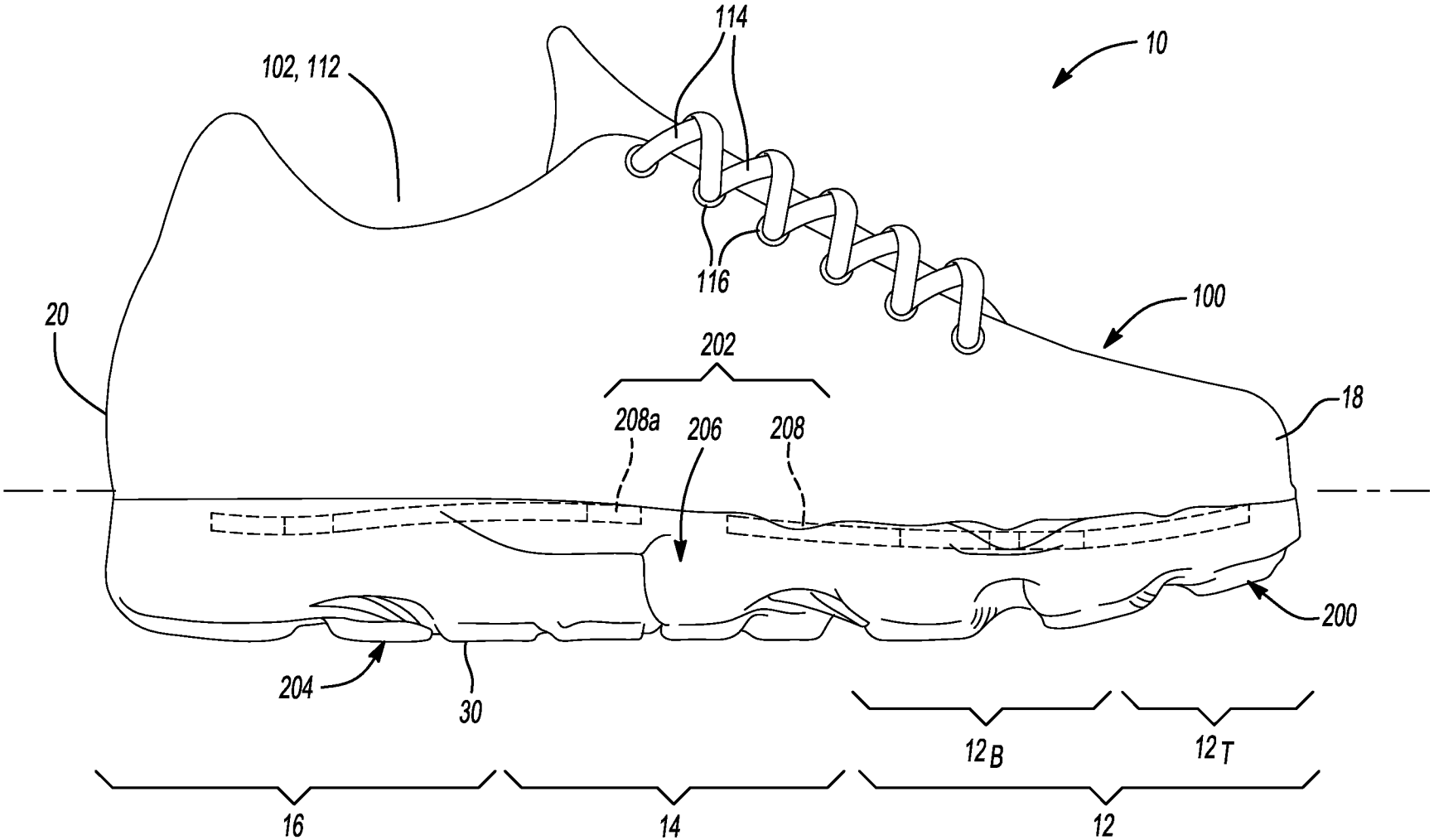
FIG. 1 is a side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one aspect, a sole structure for an article of footwear includes a bladder and at least one foam insert. The bladder includes an upper surface having a first portion defining a chamber and a second portion defining at least one recess adjacent to the chamber. The at least one foam insert is disposed within the at least one recess and has a top surface that is substantially flush with the first portion of the upper surface of the bladder. The first portion of the upper surface is exposed to the at least one foam insert.

In some implementations, the at least one foam insert is disposed between a first portion of the chamber and a second portion of the chamber. The bladder may include an upper barrier layer and a lower barrier layer attached to the upper barrier layer to form a web area between segments of the chamber. The web area may define the second portion of the upper surface.

In some implementations, the at least one foam insert includes a first segment and a second segment and the upper surface of the bladder is exposed between the first segment and the second segment. The at least one foam insert may substantially fill the at least one recess. The top surface of the at least one foam insert may be tangent with the first portion of the chamber. The chamber may be a fluid-filled chamber.

In some implementations, the bladder includes a first recess in a heel region and a second recess in a forefoot region, the at least one foam insert including a first foam insert disposed within the first recess and a second foam insert disposed within the second recess. The first portion of the bladder, a top surface of the first foam insert, and a top surface of the second foam insert may be substantially flush.

In another aspect, a sole structure for an article of footwear includes a bladder and a plurality of foam inserts. The bladder includes a chamber and a plurality of recesses formed in an upper surface of the bladder. The plurality of recesses have peripheral profiles defined by the chamber. The plurality of foam inserts are each disposed within respective ones of the plurality of the recesses and include top surfaces that are substantially flush with the upper surface of the bladder to form a substantially continuous top surface of the sole structure.

In some implementations, each of the plurality of the foam inserts is at least partially surrounded by the chamber. The bladder may include an upper barrier layer and a lower barrier layer attached to the upper barrier layer to form a web area between segments of the chamber. The web area may define the plurality of the recesses.

In some implementations, the upper surface of the bladder is exposed between the plurality of the foam inserts. The plurality of the foam inserts may substantially fill the plurality of the recesses. The top surfaces of each of the plurality of the foam inserts may be substantially flush with a portion of the upper surface corresponding to the chamber. The chamber may be a fluid-filled chamber.

In some implementations, the plurality of recesses includes a first recess in a heel region of the sole structure and a second recess in a forefoot region of the sole structure, the plurality of foam inserts including a first foam insert disposed within the first recess and a second foam insert disposed within the second recess. The plurality of recesses may include a third recess in a midfoot region of the sole structure. The plurality of foam inserts may include a third foam insert disposed within the third recess.

Referring to FIG. 1, an article of footwear 10 includes an upper 100 and a sole structure 200. The article of footwear 10 may be divided into one or more regions. The regions may include a forefoot region 12, a mid-foot region 14, and a heel region 16. The forefoot region 12 may be subdivided into a toe portion $\mathbf{12}_T$ corresponding with phalanges, and a ball portion $\mathbf{12}_B$ associated with metatarsal bones of a foot. The mid-foot region 14 may correspond with an arch area of the foot, and the heel region 16 may correspond with rear portions of the foot, including a calcaneus bone.

Figure 4:
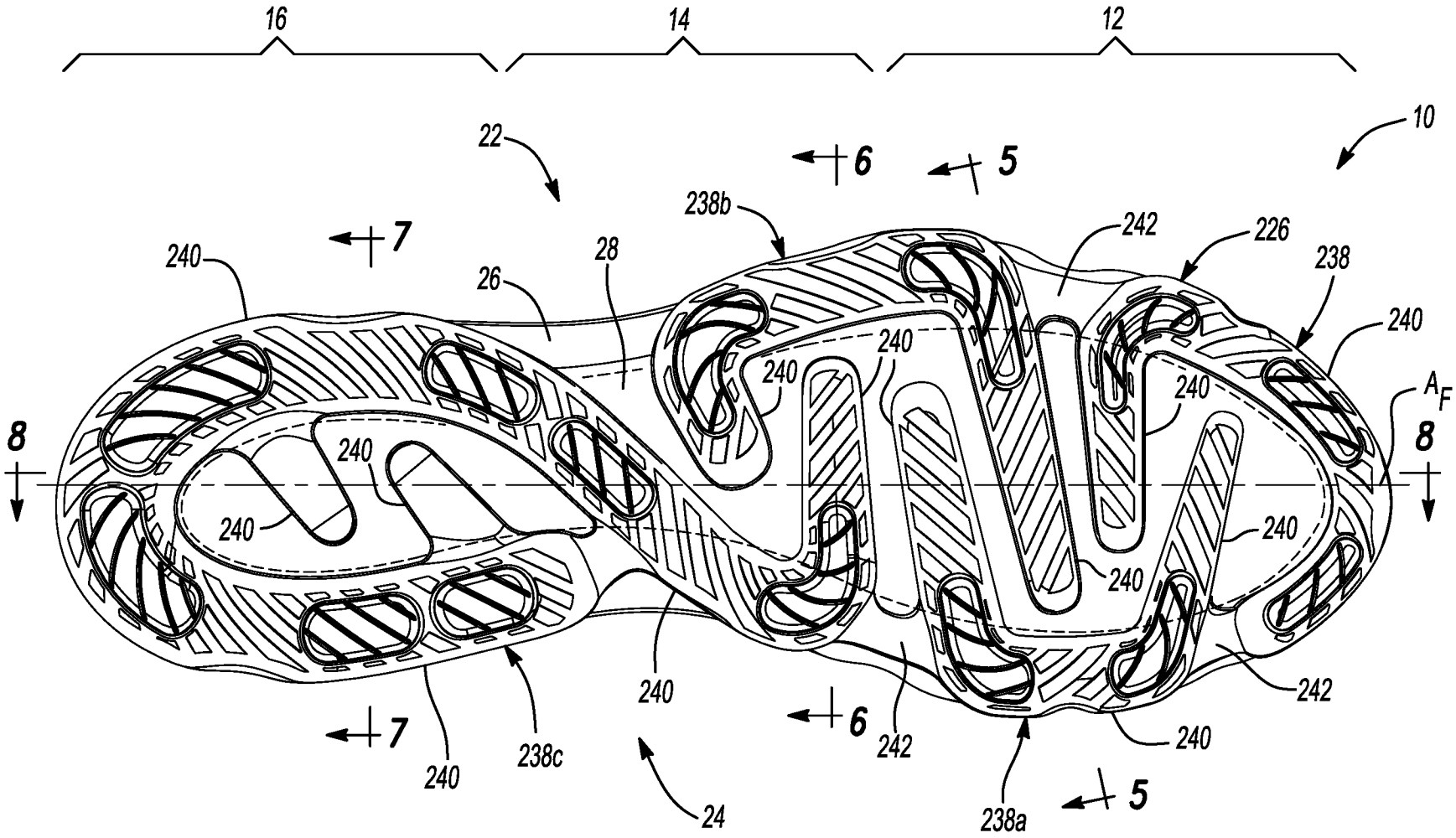
FIG. 4 is a bottom plan view of the sole structure of FIG. 3A, showing a plurality of segments and a web area of the bladder.

The footwear 10 may further include an anterior end 18 associated with a forward-most point of the forefoot region 12, and a posterior end 20 corresponding to a rearward-most point of the heel region 16. As shown in FIG. 4, a longitudinal axis $A_F$ of the footwear 10 extends along a length of the footwear 10 from the anterior end 18 to the posterior end 20, parallel to a ground surface. The longitudinal axis $A_F$ is centrally located along the length of the footwear 10, and generally divides the footwear 10 into a lateral side 22 and a medial side 24. Accordingly, the lateral side 22 and the medial side 24 respectively correspond with opposite sides of the footwear 10 and extend through the regions 12, 14, 16. As used herein, a longitudinal direction refers to the direction extending from the anterior end 18 to the posterior end 20, while a lateral direction refers to the direction transverse to the longitudinal direction and extending from the lateral side 22 and the medial side 24.

The article of footwear 10, and more particularly, the sole structure 200, may be further described as including a peripheral region 26 and an interior region 28, as signified by the dashed line in FIG. 4. The peripheral region 26 is generally described as being a region between the interior region 28 and an outer perimeter of the sole structure 200. Particularly, the peripheral region 26 extends from the forefoot region 12 to the heel region 16 along each of the medial side 24 and the lateral side 22, and wraps around each of the forefoot region 12 and the heel region 16. The interior region 28 is circumscribed by the peripheral region 26, and extends from the forefoot region 12 to the heel region 16 along a central portion of the sole structure 200.

The upper 100 includes interior surfaces that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

Figure 5:
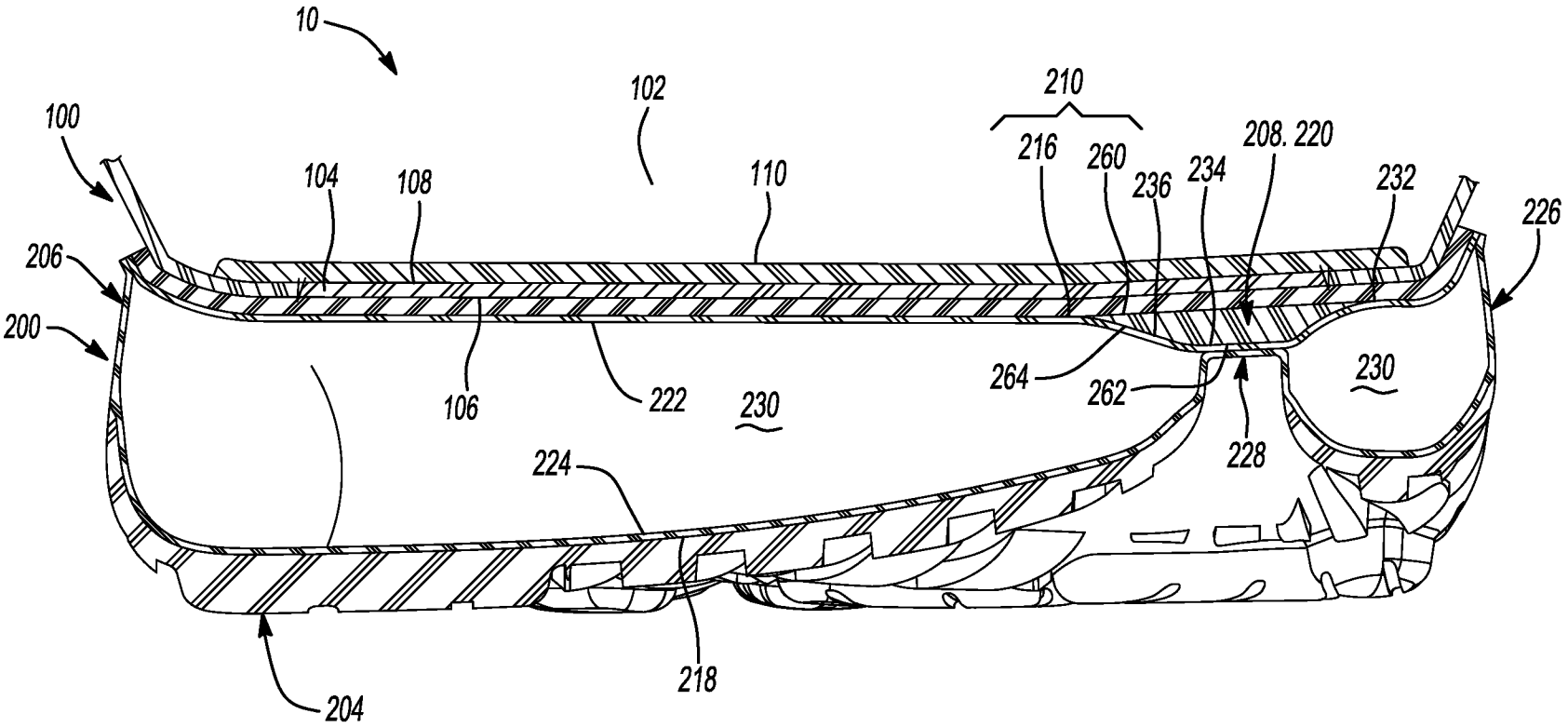
FIG. 5 is a cross-sectional view taken along line 5-5 of FIG. 4, showing segments disposed within a forefoot region of the sole structure and separated from one another by a web area.
Figure 6:
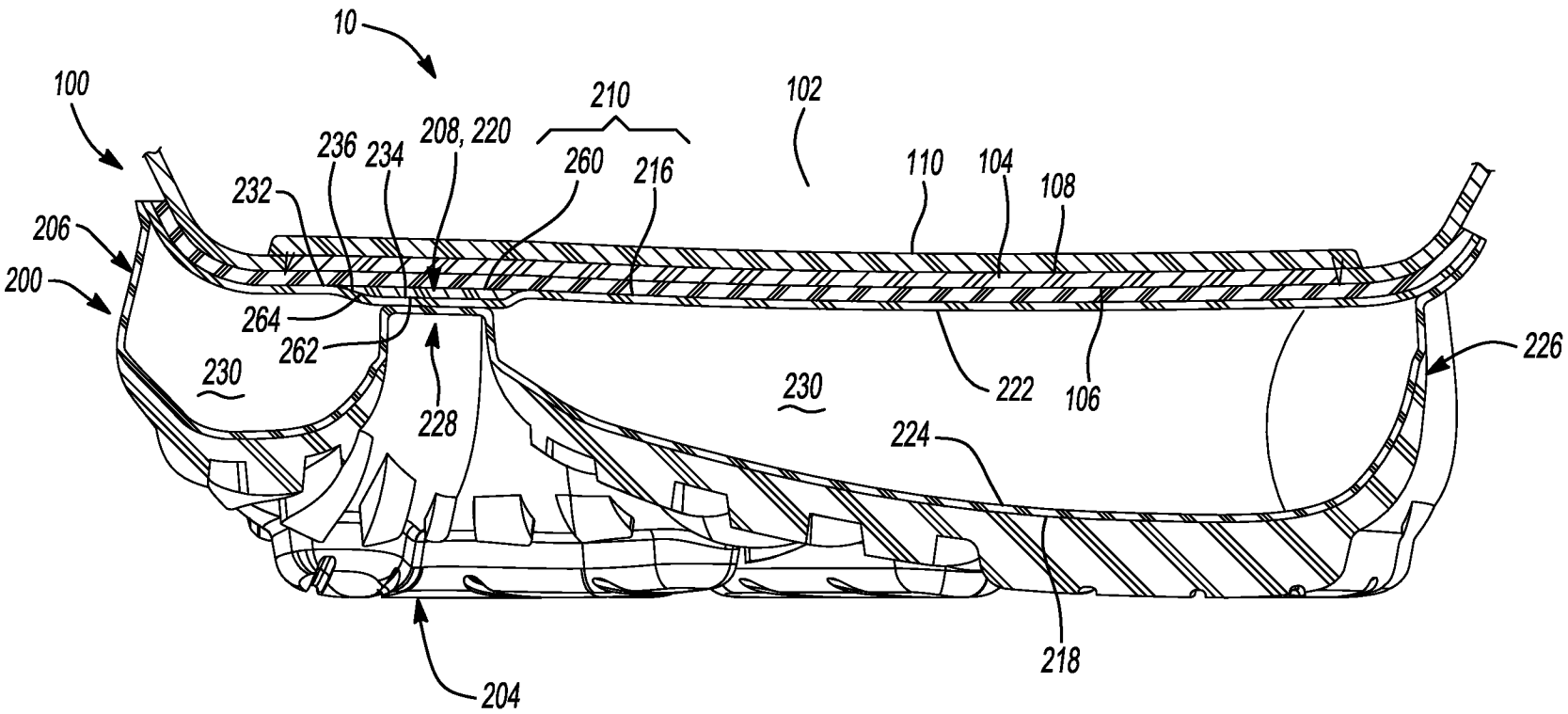
FIG. 6 is a cross-sectional view taken along line 6-6 of FIG. 4, showing segments disposed within a forefoot region of the sole structure and separated from one another by a web area.
Figure 7:
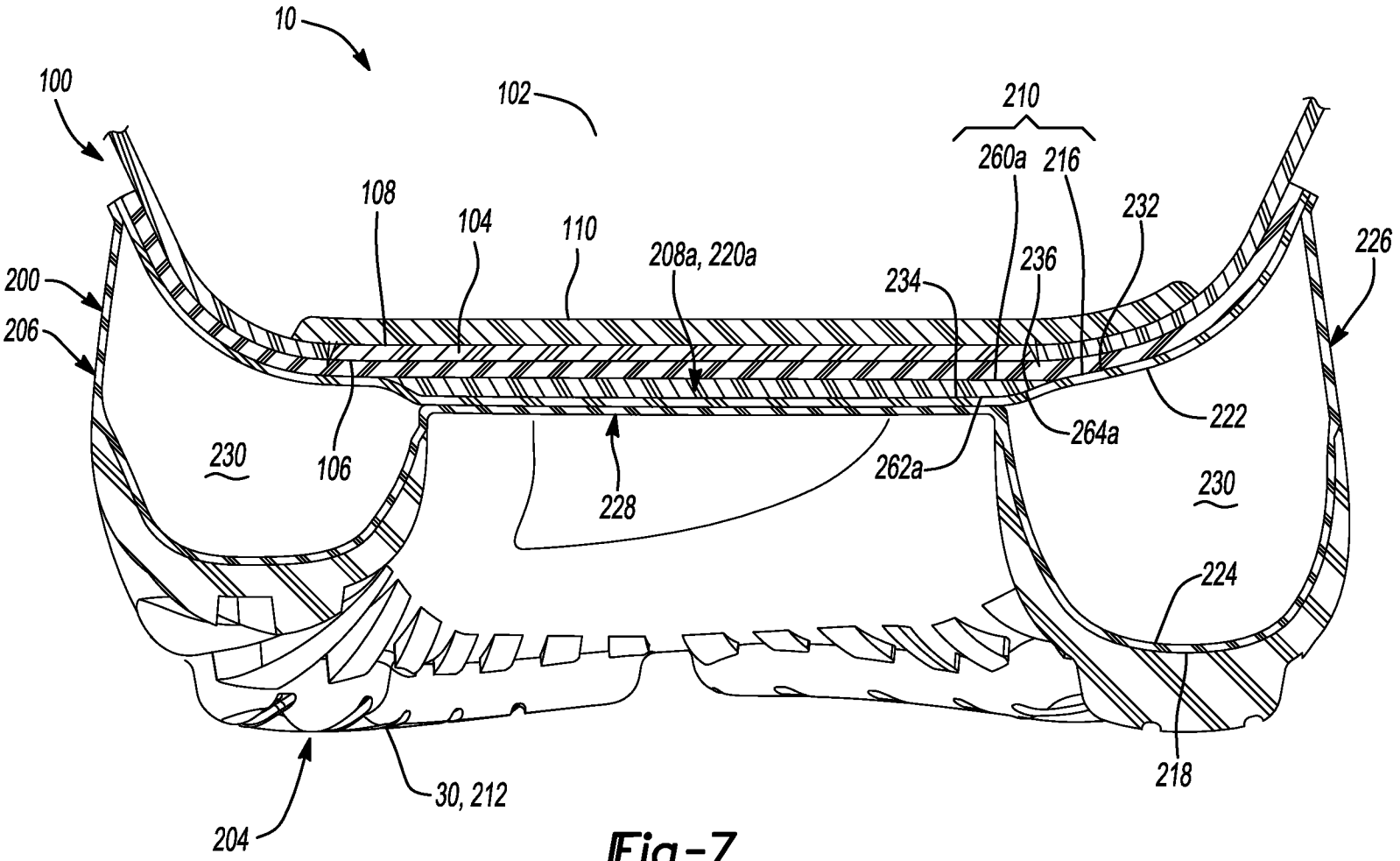
FIG. 7 is a cross-sectional view taken along line 7-7 of FIG. 4, showing segments disposed within a heel region of the sole structure and separated from one another by a web area.
Figure 8:
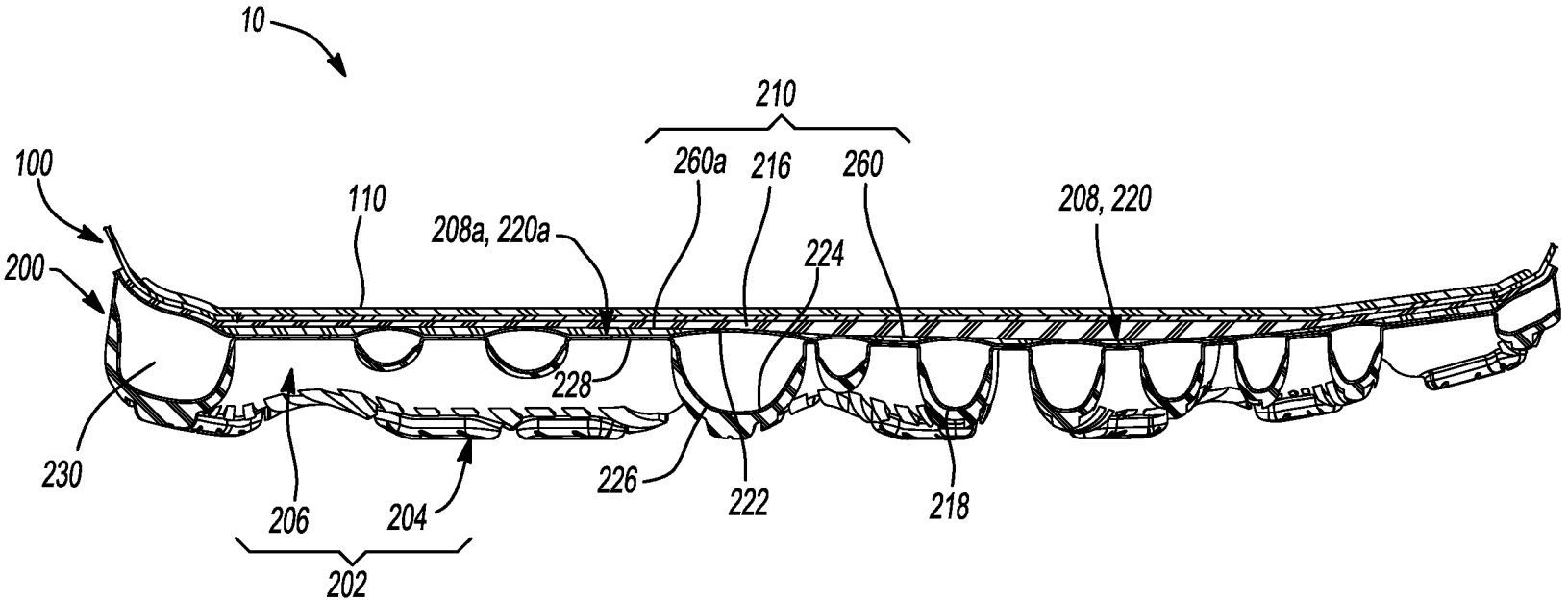
FIG. 8 is a cross-sectional view taken along line 8-8 of FIG. 4, showing segments arranged along a forefoot region, a mid-foot region, and a heel region.
Figure 9:
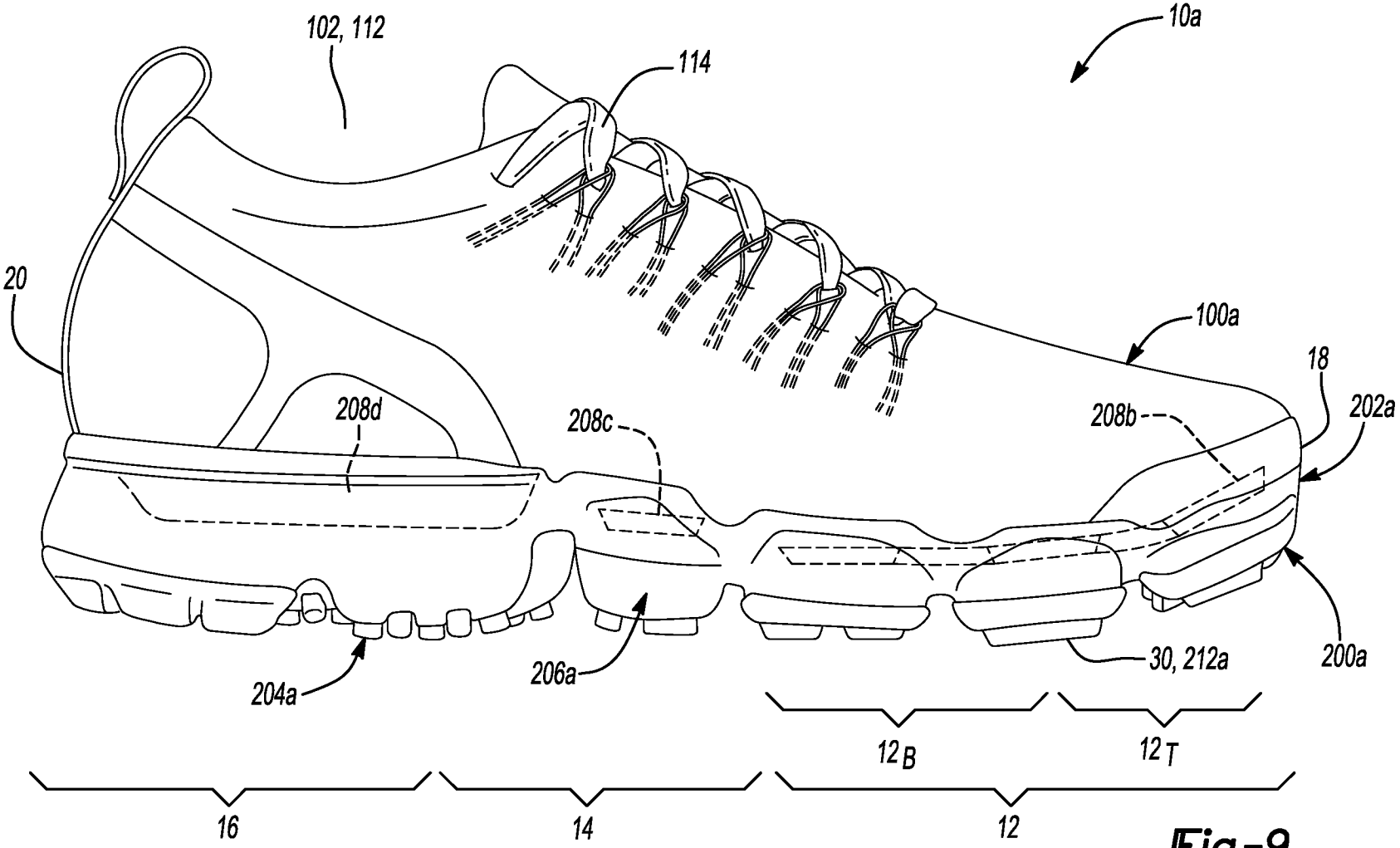
FIG. 9 is a side elevation view of an article of footwear in accordance with principles of the present disclosure.

As best shown in the cross-sectional view of FIG. 5, the upper 100 may include a strobel 104 having a bottom surface 106 opposing the sole structure 200 and an opposing top surface defining a footbed 108 of the interior void 102. Stitching or adhesives may secure the strobel 104 to the upper 100. A profile of the footbed 108 is defined by the sole structure 200, and may be contoured to conform to a profile of the bottom surface (e.g., plantar) of the foot. Optionally, the upper 100 may also incorporate additional layers such as an insole 110 or sockliner that may be disposed upon the strobel 104 and reside within the interior void 102 of the upper 100 to receive a plantar surface of the foot to enhance the comfort of the article of footwear 10.

Referring again to FIG. 1, an ankle opening 112 in the heel region 16 may provide access to the interior void 102. For example, the ankle opening 112 may receive a foot to secure the foot within the void 102 and facilitate entry and removal of the foot from and to the interior void 102. In some examples, one or more fasteners 114 extend along the upper 100 to adjust a fit of the interior void 102 around the foot and to accommodate entry and removal of the foot therefrom. The upper 100 may include apertures 116 such as eyelets and/or other engagement features such as fabric or mesh loops that receive the fasteners 114. The fasteners 114 may include laces, straps, cords, hook-and-loop, or any other suitable type of fastener. The upper 100 may include a tongue portion that extends between the interior void 102 and the fasteners 114.

Figure 2:
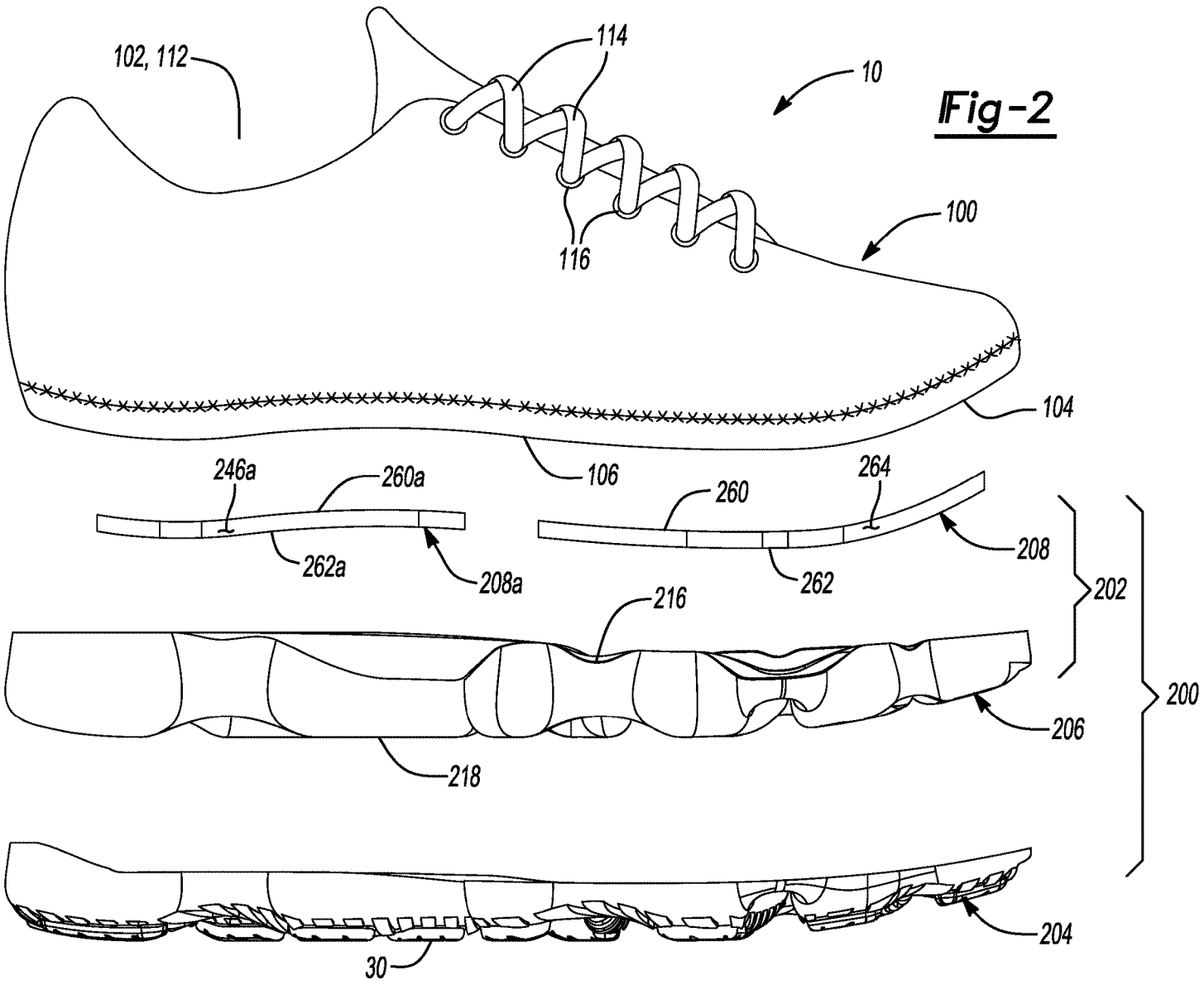
FIG. 2 is an exploded view of the article of footwear of FIG. 1 showing an article of footwear having an upper, a midsole, and an outsole arranged in a layered configuration.

With reference to FIG. 2, the sole structure 200 includes a midsole 202 and an outsole 204. Generally, the midsole 202 is configured to impart performance characteristics to the sole structure 200, such as cushioning, responsiveness, and energy distribution. The outsole 204 may be attached to or formed integrally with the midsole 202, and forms a ground-engaging surface 30 of the article of footwear 10. Accordingly, the outsole 204 is configured to impart characteristics related to traction and abrasion resistance.

Figure 3A:
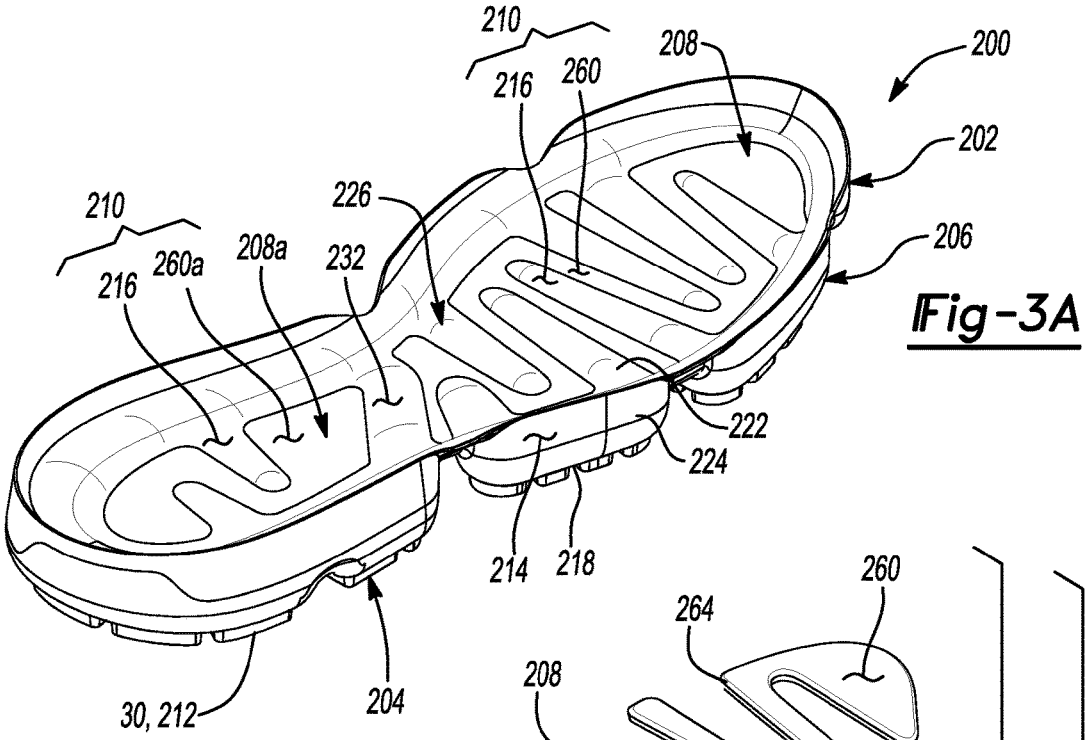
FIG. 3A is a top perspective view of a sole structure of the article of footwear of FIG. 1, showing a bladder and a plurality of foam inserts in an assembled state.
Figure 3B:
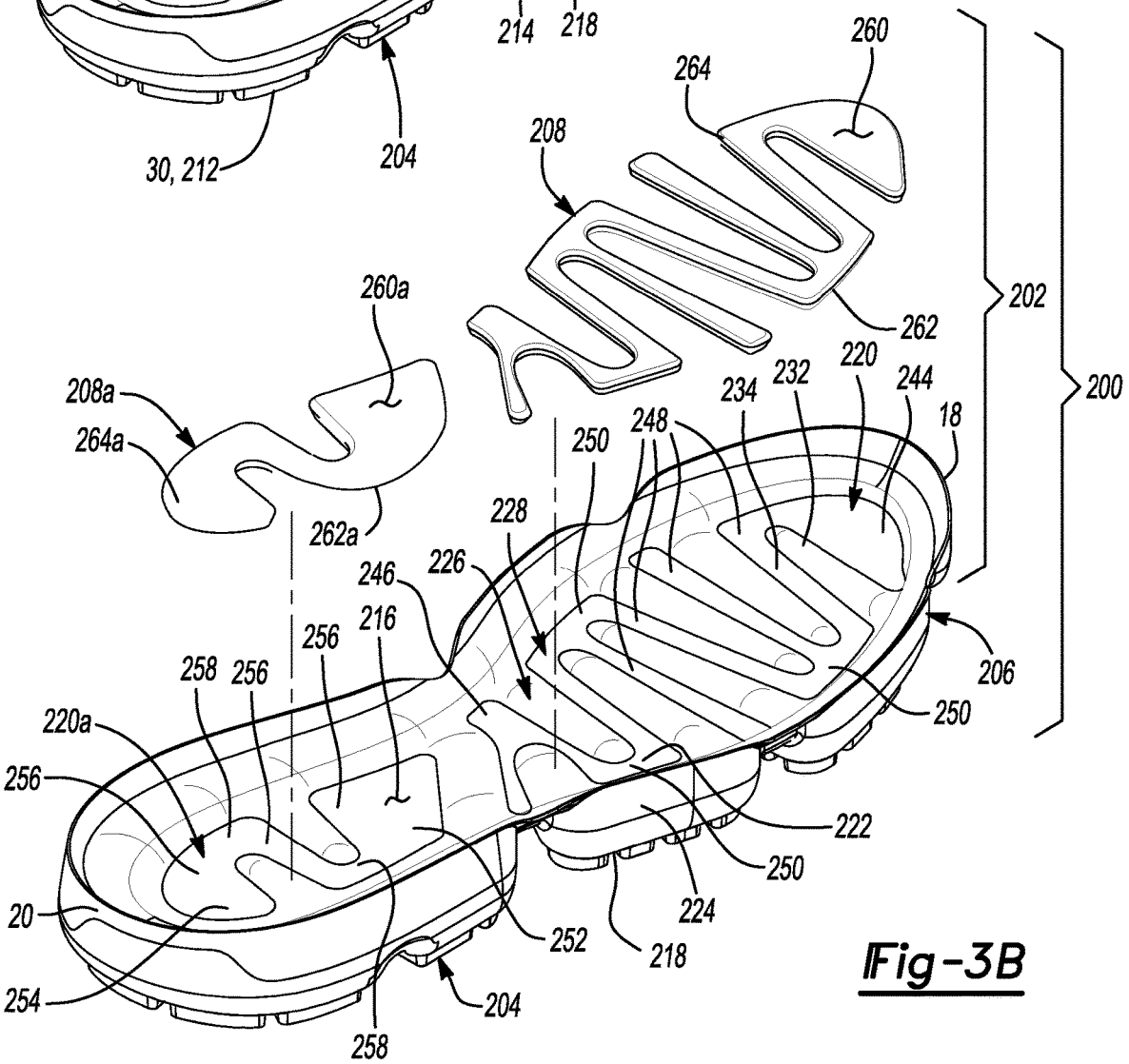
FIG. 3B is a top perspective view of the sole structure of FIG. 3A, showing the bladder and the plurality of foam inserts in an exploded state.

With reference to FIGS. 3A and 3B, the midsole 202 is formed as a composite structure, and includes a bladder 206 and one or more foam inserts 208, 208*a*. As described in greater detail below, the bladder 206 and the foam inserts 208, 208*a* cooperate to form a substantially flush and continuous top surface 210 of the midsole 202, which defines the shape of the footbed 108. The midsole 202 further includes a bottom surface 212 formed on an opposite side of the midsole 202 from the top surface 210. The bottom surface 212 defines a profile of the ground-engaging surface 30 of the sole structure 200. A peripheral side surface 214 of the midsole 202 extends between the top surface 210 and the bottom surface 212, and defines an outer peripheral profile of the sole structure 200.

With reference to FIG. 3B, the bladder 206 is configured to extend from the anterior end 18 to the posterior end 20 of the footwear 10. The bladder 206 may be described as including an upper surface 216 and a lower surface 218 formed on an opposite side of the bladder 206 from the upper surface 216. As described in greater detail below, and best shown in FIG. 3B, the upper surface 216 of the bladder 206 may include one or more recesses 220, 220*a* formed therein. In the illustrated example, the upper surface 216 includes a forefoot recess 220 extending through the forefoot region 12 and the mid-foot region 14, and a heel recess 220*a* formed in the heel region 16. As described in greater detail below, and illustrated in FIGS. 3A and 3B, when the midsole 202 is assembled, the foam inserts 208, 208*a* are received within the respective recesses 220, 220*a* such that the upper surface 216 of the bladder 206 is exposed and cooperates with top surfaces of the inserts 208, 208*a* to provide a continuous and substantially flush top surface 210 of the midsole 202.

With continued reference to FIG. 3B, the bladder 206 is constructed of an upper barrier layer 222 and a lower barrier layer 224, which are joined together with each other at discrete locations to form a chamber 226 and a web area 228. The chamber 226 is associated with an area of the bladder 206 where interior surfaces of the upper and lower barrier layers 222, 224 are not joined together and, thus, are separated from one another to define an interior void 230 of the bladder 206, as shown in the cross-sectional views of FIG. 5-8. Conversely, the web area 228 is associated with areas of the bladder 206 where the upper barrier layer 222 is joined to the lower barrier layer 224. With reference to FIG. 3B, the chamber 226 and the web area 228 cooperate to define the recesses 220, 220*a* in the upper surface 216 of the bladder 206, whereby the web area 228 defines a bottom portion of the recesses 220, 220*a* and the chamber 226 defines an outer periphery of the recesses 220, 220*a*.

As used herein, the term "barrier layer" (e.g., barrier layers 222, 224) encompasses both monolayer and multilayer films. In some embodiments, one or both of barrier layers 222, 224 are each produced (e.g., thermoformed or blow molded) from a monolayer film (a single layer). In other embodiments, one or both of the barrier layers 222, 224 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 222, 224 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 222, 224 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocyanates including Hexamethylene diisocyanate (HMDI), TDI, MDI, aliphatic diisocyanates (i.e., H12), and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 222, 224 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 222, 224 include two or more sublayers, examples of suitable multilayer films include microlayer films, such as those disclosed in Bonk et al., U.S. Pat. No. 6,582,786, which is incorporated by reference in its entirety. In further embodiments, the barrier layers 222, 224 may each independently include alternating sublayers of one or more TPU copolymer materials and one or more EVOH copolymer materials, where the total number of sublayers in each of the barrier layers 222, 224 includes at least four (4) sublayers, at least ten (10) sublayers, at least twenty (20) sublayers, at least forty (40) sublayers, and/or at least sixty (60) sublayers.

The chamber 226 can be produced from the barrier layers 222, 224 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 222, 224 can be produced by co-extrusion followed by vacuum thermoforming to produce an inflatable chamber 226, which can optionally include one or more valves (e.g., one way valves) that allows the chamber 226 to be filled with the fluid (e.g., gas).

The chamber 226 can be provided in a fluid-filled (e.g., as provided in footwear 10) or in an unfilled state. The chamber 226 can be filled to include any suitable fluid, such as a gas or liquid. In an aspect, the gas can include air, nitrogen ($N_2$), or any other suitable gas. In other aspects, the chamber 226 can alternatively include other media, such as pellets, beads, ground recycled material, and the like (e.g., foamed beads and/or rubber beads). The fluid provided to the chamber 226 can result in the chamber 226 being pressurized. Alternatively, the fluid provided to the chamber 226 can be at atmospheric pressure such that the chamber 226 is not pressurized but, rather, simply contains a volume of fluid at atmospheric pressure.

The chamber 226 desirably has a low gas transmission rate to preserve its retained gas pressure. In some embodiments, the chamber 226 has a gas transmission rate for nitrogen gas that is at least about ten (10) times lower than a nitrogen gas transmission rate for a butyl rubber layer of substantially the same dimensions. In an aspect, the chamber 226 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 222, 224). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

In some examples, the formation of the recesses 220, 220*a* in the upper surface 216 is induced by filling the interior void 230 of the chamber 226 with a pressurized fluid, causing the upper barrier layer 222 to bulge in areas that are not joined to the lower barrier layer 224 (i.e., the chamber 226). For example, the upper barrier layer 222 of the bladder 206 may be substantially planar, or have a continuous contour when the chamber 226 is in an unfilled or relaxed state. However, when the interior void 230 of the chamber 226 is filled, the upper barrier layer 222 and the lower barrier layer 224 will be biased apart from each other. Even where the upper barrier layer 222 has a naturally flat or continuous profile in the relaxed state, the filling of the interior void 230 will cause the upper barrier layer 222 to bulge in areas that are not joined to the lower barrier layer 224 (i.e., the web area 228), thereby forming the one or more recesses 220, 220*a* in between adjacent segments of the chamber 226. In some examples, the upper barrier layer 222 may be molded or pre-formed to include one or more of the recesses 220, 220*a* in areas that are not joined to the lower barrier layer 224.

As shown in the cross-sectional view of FIGS. 5-8, exterior surfaces of the upper and lower barrier layers 222, 224 define the respective upper and lower surfaces 216, 218 of the bladder 206. Accordingly, when the interior void 230 of the chamber 226 is filled with a fluid and the upper barrier layer 222 is caused to bulge, the upper surface 216 of the bladder 206 can be described as having an outer portion 232, an inner portion 234, and a peripheral portion 236 connecting the outer portion 232 to the inner portion 234. Generally, the outer portion 232 and the peripheral portion 236 are associated with the chamber 226, while the inner portion 234 is associated with the web area 228. The outer portion 232 of the upper surface 216 corresponds to a portion of the upper barrier layer 222 that is spaced farthest away from the lower barrier layer 224 along a direction perpendicular to the ground-engaging surface 30, while the inner portion 234 is associated with a portion of the upper barrier layer 222 that is disposed closest to the lower barrier layer 224. In the illustrated example, the inner portion 234 is associated with the portion of the upper barrier layer 222 that is joined to the lower barrier layer 224 (i.e., the web area 228). The peripheral portion 236 is associated with an intermediate portion of the chamber 226 that extends from the web area 228 (i.e., the inner portion 234) to the top-most portion of the chamber 226 (i.e., the outer portion 232).

With reference to FIG. 4, the chamber 226 may be described as including a plurality of sub-chambers 238-238*c* each comprising a plurality segments 240 that are at least partially spaced apart from each other by the web area 228 and cooperate to define a profile of the ground-engaging surface 30 of the footwear 10. The segments 240 of each sub-chamber 238-238*c* are indirect fluid communication with each other. Further, a series of the segments 240 are arranged sequentially with each other, as best shown in FIG. 4. The chamber 226 may further include one or more conduits 242 that provide fluid communication between pairs of the sub-chambers 238-238*c*. In some examples, all of the sub-chambers 238-238*c* may be in fluid communication with one or more conduits 242 to form a substantially continuous chamber 226 along the length of the sole structure 200. Accordingly, the chamber 226 may comprise a continuous network of fluidly connected sub-chambers 238-238*c*, whereby a change in pressure in a first one of the sub-chambers 238-238*c* is transmitted to a second one of the sub-chambers 238-238*c*. In other examples, one or more of the sub-chambers 238-238*c* may be fluidly isolated, where each sub-chamber 238-238*c* includes a plurality of interconnected segments 240 that are isolated from the interconnected segments 240 forming the other sub-chambers 238-238*c*.

Each of the segments 240 and the conduits 242 may be filled with a pressurized fluid (i.e., gas, liquid) to provide cushioning and stability for the foot during use of the footwear 10. In some implementations, compressibility of a first portion of the plurality of segments 240 of the sub-chambers 238-238*c* under an applied load provides a responsive-type cushioning, while a second portion of the segments 240 of the sub-chambers 238-238*c* may be configured to provide a soft-type cushioning under an applied load. Accordingly, the sub-chambers 238-238*c* may cooperate to provide gradient cushioning to the article of footwear 10 that changes as the applied load changes (i.e., the greater the load, the more the segments 240 are compressed and, thus, the more responsive the footwear 10 performs).

In other implementations, one or more cushioning materials (none shown), such as polymer foam and/or particulate matter, are enclosed by one or more of the segments 240 in place of, or in addition to, the pressurized fluid to provide cushioning for the foot. In these implementations, the cushioning materials may provide one or more of the segments 240 with cushioning properties different from the segments 240 filled with the pressurized fluid. For example, the cushioning materials may be more or less responsive or provide greater impact absorption than the pressurized fluid.

As discussed above, the recesses 220, 220*a* may be formed between bulges in the upper surface 216, which are created when the interior void 230 of the chamber 226 is filled and the upper barrier layer 222 is biased apart from the lower barrier layer 224. Accordingly, the profiles of the recesses 220, 220*a* formed in the upper surface 216 correspond to the arrangement of the sub-chambers 238-238*c*, segments 240, and/or conduits 242. In the example of the bladder 206 shown in FIG. 3B, the chamber 226 forms a forefoot recess 220 in the forefoot region 12, and a heel recess 220*a* in the heel region 16.

With continued reference to FIG. 3B, the forefoot recess 220 extends continuously from a first end 244 at the anterior end 18 to a second end 246 in the mid-foot region 14 of the sole structure 200. Here, the forefoot recess 220 may be described as including a plurality of interconnected segments 248, 250 arranged in a substantially continuous and serpentine manner from the anterior end 18 to the mid-foot region 14. In other words, the forefoot recess 220 includes a first plurality of laterally extending segments 248 each extending continuously across the width of the bladder 206 from the lateral side 22 to the medial side 24, and a first plurality of longitudinally extending segments 250 extending between and connecting adjacent ones of the laterally extending segments 248 along the lateral side 22 and the medial side 24.

Referring still to FIG. 3B, the heel recess 220*a* extends continuously from a first end 252 in the mid-foot region 14 to a second end 254 at the posterior end 20. As with the forefoot recess 220, the heel recess 220*a* includes a plurality of laterally extending segments 256 extending across the width of the bladder 206 from the lateral side 22 to the medial side 24. The heel recess 220*a* also includes longitudinally extending segments 258 extending along the lateral side 22 and/or the medial side 24, and connecting ends of adjacent ones of the laterally extending segments 256.

With continued reference to FIGS. 3A and 3B, the illustrated example of the sole structure 200 includes a first foam insert 208 associated with the forefoot recess 220 of the sole structure 200, and a second foam insert 208*a* associated with the heel recess 220*a* of the sole structure 200. Each of the inserts 208, 208*a* includes a top surface 260, 260*a* and a bottom surface 262, 262*a* formed on an opposite side of the foam insert 208, 208*a* from the top surface 260, 260*a*. A peripheral side surface 264, 264*a* of each of the inserts 208, 208*a* extends from the top surface 260, 260*a* to the bottom surface 262, 262*a*.

Generally, each of the foam inserts 208, 208*a* is configured to be received within the respective recesses 220, 220*a*. As described above, the foam inserts 208, 208*a* may cooperate with the outer portion 232 of the upper surface 216 of the bladder 206 to form the top surface 210 of the midsole 202, which may be contoured to accommodate a profile of a plantar surface of a foot. Accordingly, the foam inserts 208, 208*a* may be formed such that the top surfaces 260, 260*a* merge with the outer portion 232 of the upper surface 216 of the bladder 206 in a substantially tangential relationship, thereby forming a continuous and substantially flush top surface 210 of the midsole 202. As shown in FIG. 3A, when the foam inserts 208, 208*a* are assembled within the recesses 220, 220*a*, the outer portion 232 of the upper surface 216 of the bladder 206 will be exposed between the segments of the foam inserts 208, 208*a* corresponding to the segments 256, 258 of the recesses 220, 220*a*.

With reference to the cross-sectional views of FIGS. 5-8, the foam inserts 208, 208*a* are configured to fill the recesses 220, 220*a* to form a substantially continuous and flush top surface 210 of the midsole 202. Accordingly, the bottom surfaces 262, 262*a* of the foam inserts 208, 208*a* are configured to oppose or interface with the inner portion 234 of the upper surface 216, while the peripheral side surfaces 264, 264*a* are configured to cooperate with the peripheral portion 236 of the upper surface 216. Accordingly, where the web area 228 is substantially planar, as shown, the bottom surfaces 262, 262*a* of the foam inserts 208, 208*a* will also be substantially planar. Likewise, where the peripheral portion 236 of the upper surface 216 of the bladder 206 has a convex profile, the peripheral side surfaces 264, 264*a* of the inserts 208, 208*a* will have a concave profile configured to receive the peripheral portion 236 of the upper surface 216. As such, the inserts 208, 208*a* are shaped to be matingly received by the respective recesses 220, 220*a* such that the inserts 208, 208*a* substantially fill the respective recesses 220, 220*a*.

As described above, the foam inserts 208, 208*a* are formed of a resilient polymeric material, such as foam or rubber, to impart properties of cushioning, responsiveness, and energy distribution to the foot of the wearer. In one example, the first foam insert 208 and the second foam insert 208*a* are formed of the same material to impart similar performance characteristics to each of the forefoot region 12, the mid-foot region 14, and the heel region 16. In other examples, the first foam insert 208 and the second foam insert 208*a* may be formed of different materials to impart different characteristics to at least one of the forefoot region 12, the mid-foot region 14, and the heel region 16.

Example resilient polymeric materials for the inserts 208, 208*a* may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Examples of suitable polyurethanes include those discussed above for barrier layers 222, 224. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Referring now to FIGS. 9-16, an article of footwear 10*a* is provided and includes an upper 100*a* and a sole structure 200*a* attached to the upper 100*a*. In view of the substantial similarity in structure and function of the components associated with the article of footwear 10*a* with respect to the article of footwear 10, like reference numerals are used hereinafter and in the drawings to identify like components while like reference numerals containing letter extensions are used to identify those components that have been modified.

Figure 10:
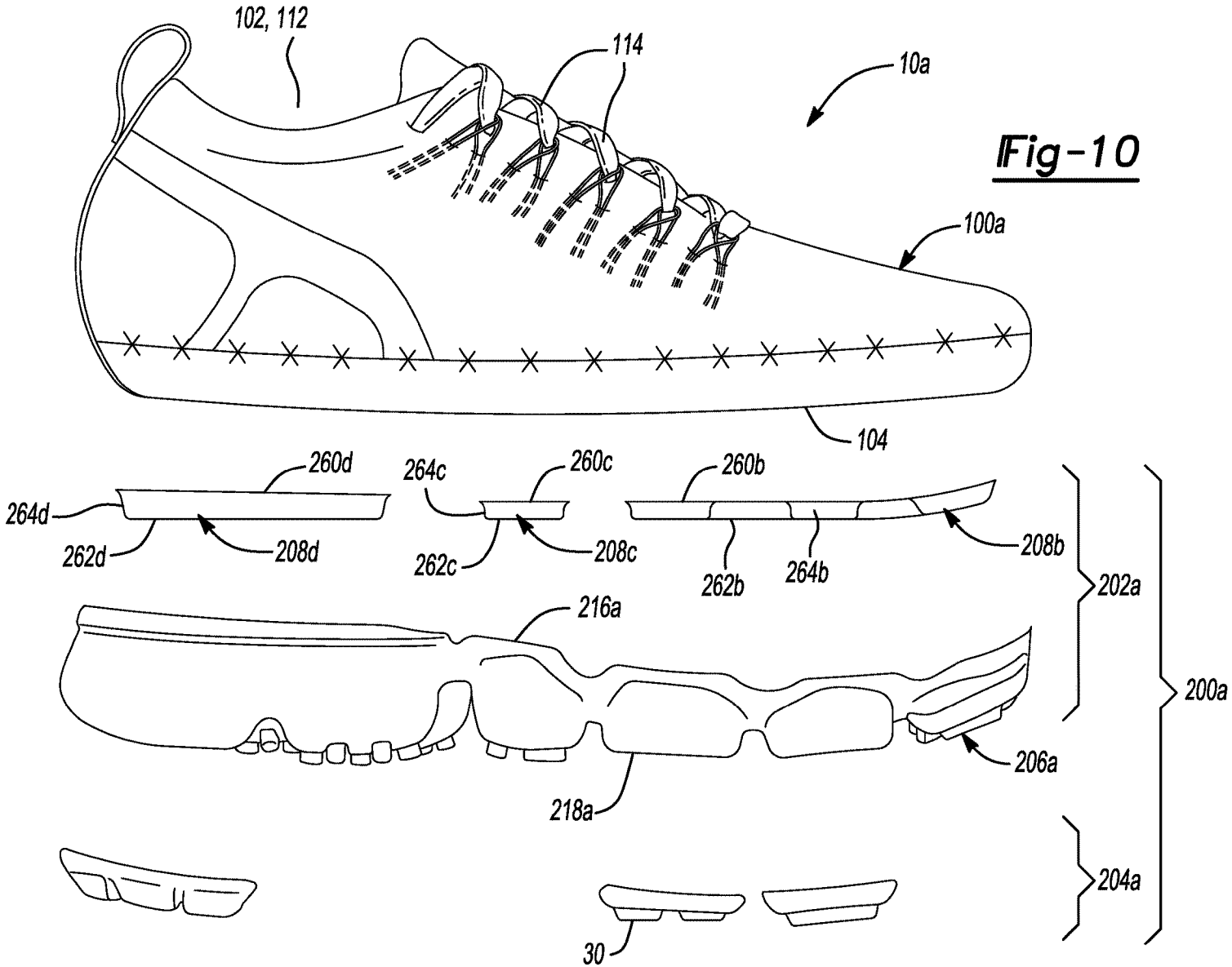
FIG. 10 is an exploded view of the article of footwear of FIG. 9 showing an article of footwear having an upper, a midsole, and an outsole arranged in a layered configuration.

With reference to FIG. 10, the sole structure 200*a* includes a midsole 202*a* and an outsole 204*a*. Generally, the midsole 202*a* is configured to impart performance characteristics to the sole structure 200*a*, such as cushioning, responsiveness, and energy distribution. The outsole 204*a* may be attached to or formed integrally with the midsole 202*a*, and forms a ground-engaging surface 30 of the article of footwear 10*a*. Accordingly, the outsole 204*a* is configured to impart characteristics related to traction and abrasion resistance.

Figure 11A:
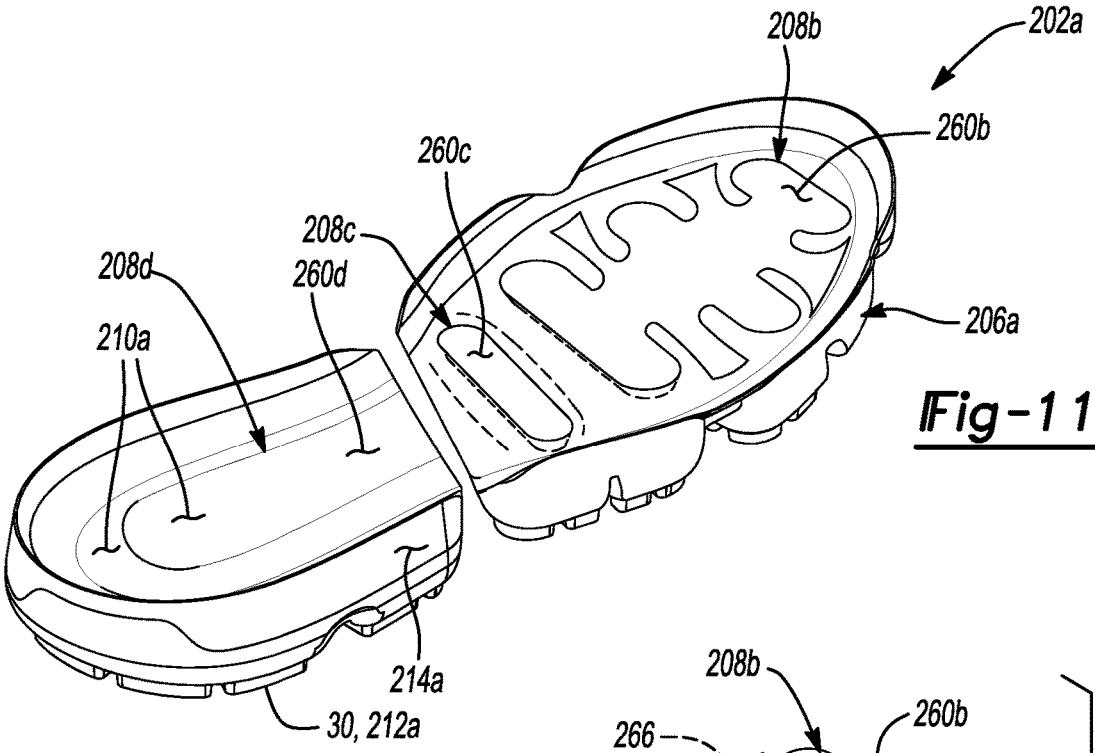
FIG. 11A is a top perspective view of a sole structure of the article of footwear of FIG. 9, showing a bladder and a plurality of foam inserts in an assembled state.
Figure 11B:
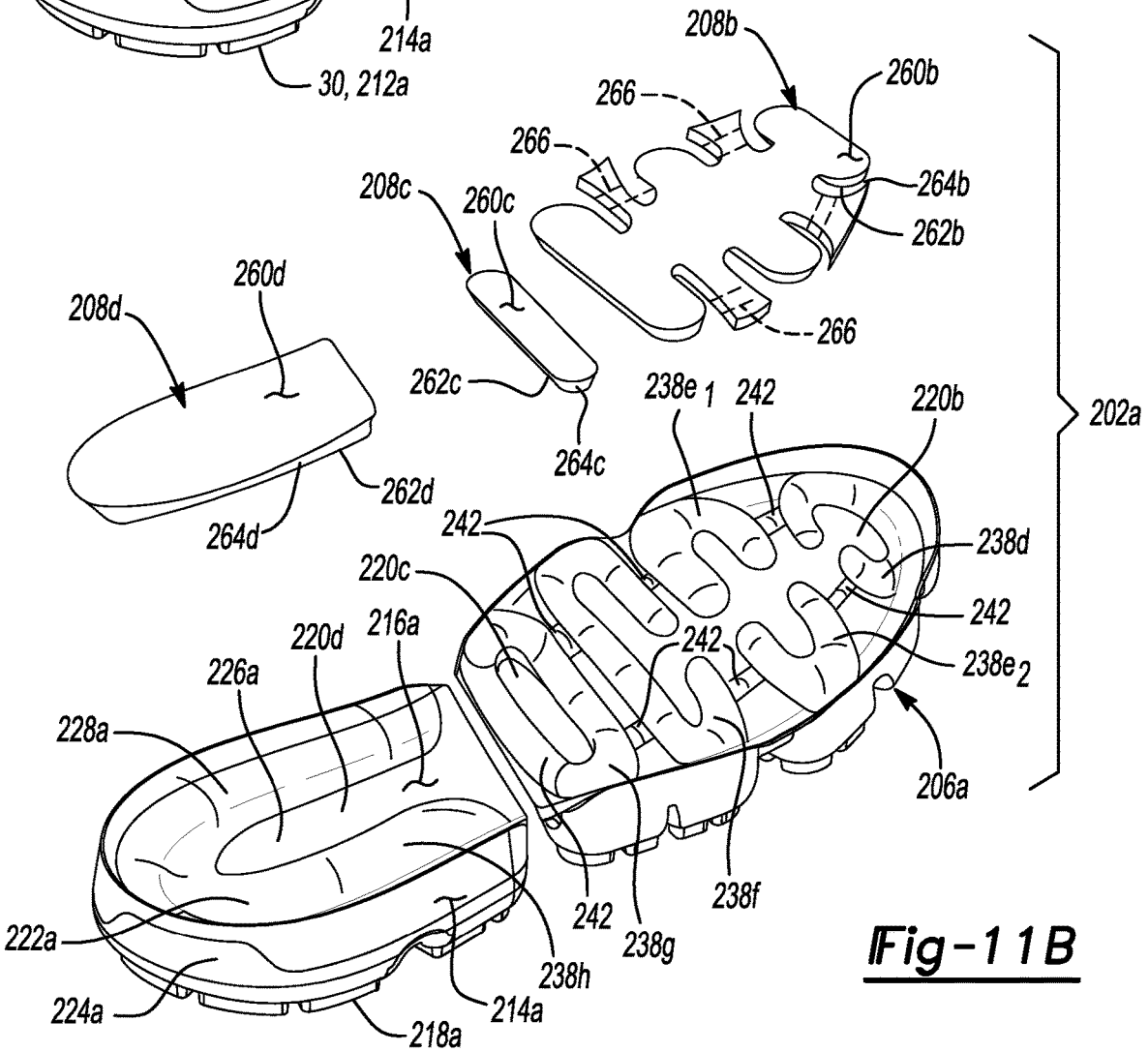
FIG. 11B is a top perspective view of the sole structure of FIG. 11A, showing the bladder and the plurality of foam inserts in an exploded state.

With reference to FIGS. 11A and 11B, the midsole 202*a* is formed as a composite structure, and includes a bladder 206*a* and one or more foam inserts 208*b*-208*d*. As described in greater detail below, the bladder 206*a* and the foam inserts 208*b*-208*d* cooperate to form a substantially flush and continuous top surface 210*a* of the midsole 202*a*, which defines the contours of the footbed 108. The midsole 202*a* further includes a bottom surface 212*a* formed on an opposite side of the midsole 202*a* from the top surface 210*a*, and defines a profile of the ground-engaging surface 30 of the sole structure 200*a*. A peripheral side surface 214*a* of the midsole 202*a* extends between the top surface 210*a* and the bottom surface 212*a*, and defines an outer peripheral profile of the sole structure 200*a*.

With reference to FIG. 11B, the bladder 206*a* is configured to extend from the anterior end 18 to the posterior end 20 of the footwear 10*a*. The bladder 206*a* may be described as including an upper surface 216*a* and a lower surface 218*a* formed on an opposite side of the bladder 206*a* from the upper surface 216*a*. As described in greater detail below, and best shown in FIG. 11B, the upper surface 216*a* may include one or more recesses 220*b*-220*d* formed therein. In the illustrated example, the upper surface 216*a* includes a plurality of recesses 220*b*-220*c* spaced along the forefoot region 12 and the mid-foot region 14, and a longitudinal recess 220*d* formed in the heel region 16. As described in greater detail below, and illustrated in FIGS. 11A and 11B, when the midsole 202*a* is assembled, the foam inserts 208*b*-208*d* are received within the respective recesses 220*b*-220*d* such that the upper surface 216*a* of the bladder 206*a* is exposed and cooperates with upper surfaces of the inserts 208*b*-208*d* to provide a continuous and substantially flush top surface 210*a* of the midsole 202*a*.

With continued reference to FIG. 11, the bladder 206*a* is constructed of an upper barrier layer 222*a* and a lower barrier layer 224*a*, which are joined together with each other at discrete locations to form a chamber 226*a* and a web area 228*a*. The bladder 206*a*, and particularly the barrier layers 222*a*, 224*a* of the bladder 206*a*, can be constructed using the same materials and processes described above with respect to the barrier layers 222, 224 and bladder 206 of the article of footwear 10.

The chamber 226*a* is associated with an area of the bladder 206*a* where interior surfaces of the upper and lower barrier layers 222*a*, 224*a* are not joined together and, thus, are separated from one another to define an interior void 230*a* of the bladder 206*a*, as shown in the cross-sectional views of FIG. 13-16. Conversely, the web area 228*a* is associated with areas of the bladder 206*a* where the upper barrier layer 222*a* is joined to the lower barrier layer 224*a*. With reference to FIG. 11B, the chamber 226*a* and the web area 228*a* cooperate to define the recesses 220*b*-220*d* in the upper surface 216*a* of the bladder 206*a*, whereby the web area 228*a* defines a bottom portion of the recesses 220*b*-220*d* and the chamber 226*a* defines an outer periphery of the recesses 220*b*-220*d*.

In some examples, the formation of the recesses 220*b*-220*d* in the upper surface 216*a* is induced by filling the interior void 230*a* of the chamber 226*a* with a pressurized fluid, causing the upper barrier layer 222*a* to bulge in areas that are not joined to the lower barrier layer 224*a* (i.e., the chamber 226*a*). For example, the upper barrier layer 222*a* of the bladder 206*a* may be substantially planar, or have a continuous contour when the chamber 226*a* is in an unfilled or relaxed state. However, when the interior void 230*a* of the chamber 226*a* is filled, the upper barrier layer 222*a* and the lower barrier layer 224*a* will be biased apart from each other. Even where the upper barrier layer 222*a* has a naturally flat or continuous profile in the relaxed state, the filling of the interior void 230*a* will cause the upper barrier layer 222*a* to bulge in areas that are not joined to the lower barrier layer 224*a* (i.e., the web area 228*a*), thereby forming the one or more recesses 220*b*-220*d* in between the chamber 226*a*. In some examples, the upper barrier layer 222*a* may be molded or pre-formed to include one or more of the recesses 220*b*-220*d* in areas that are not joined to the lower barrier layer 224*a*.

As shown in the cross-sectional view of FIGS. 13-16, exterior surfaces of the upper and lower barrier layers 222*a*, 224*a* define the respective upper and lower surfaces 216*a*, 218*a* of the bladder 206*a*. When the interior void 230 of the chamber 226*a* is filled and the upper barrier layer 222*a* is caused to bulge, the upper surface 216*a* of the bladder 206*a* can be described as having an outer portion 232, an inner portion 234, and a peripheral portion 236 connecting the outer portion 232 to the inner portion 234. Generally, the outer portion 232 and the peripheral portion 236 are associated with the chamber 226*a*, while the inner portion 234 is associated with the web area 228*a*. The outer portion 232 of the upper surface 216*a* corresponds to a portion of the upper barrier layer 222*a* that is spaced farthest away from the lower barrier layer 224*a* along a direction perpendicular to the ground-engaging surface 30, while the inner portion 234 is associated with a portion of the upper barrier layer 222*a* that is joined to the lower barrier layer 224*a*. The peripheral portion 236 is associated with an intermediate portion of the chamber 226*a* that extends from the web area 228*a* (i.e., the inner portion 234) to the top-most portion of the chamber 226*a* (i.e., the outer portion 232).

Figure 12:
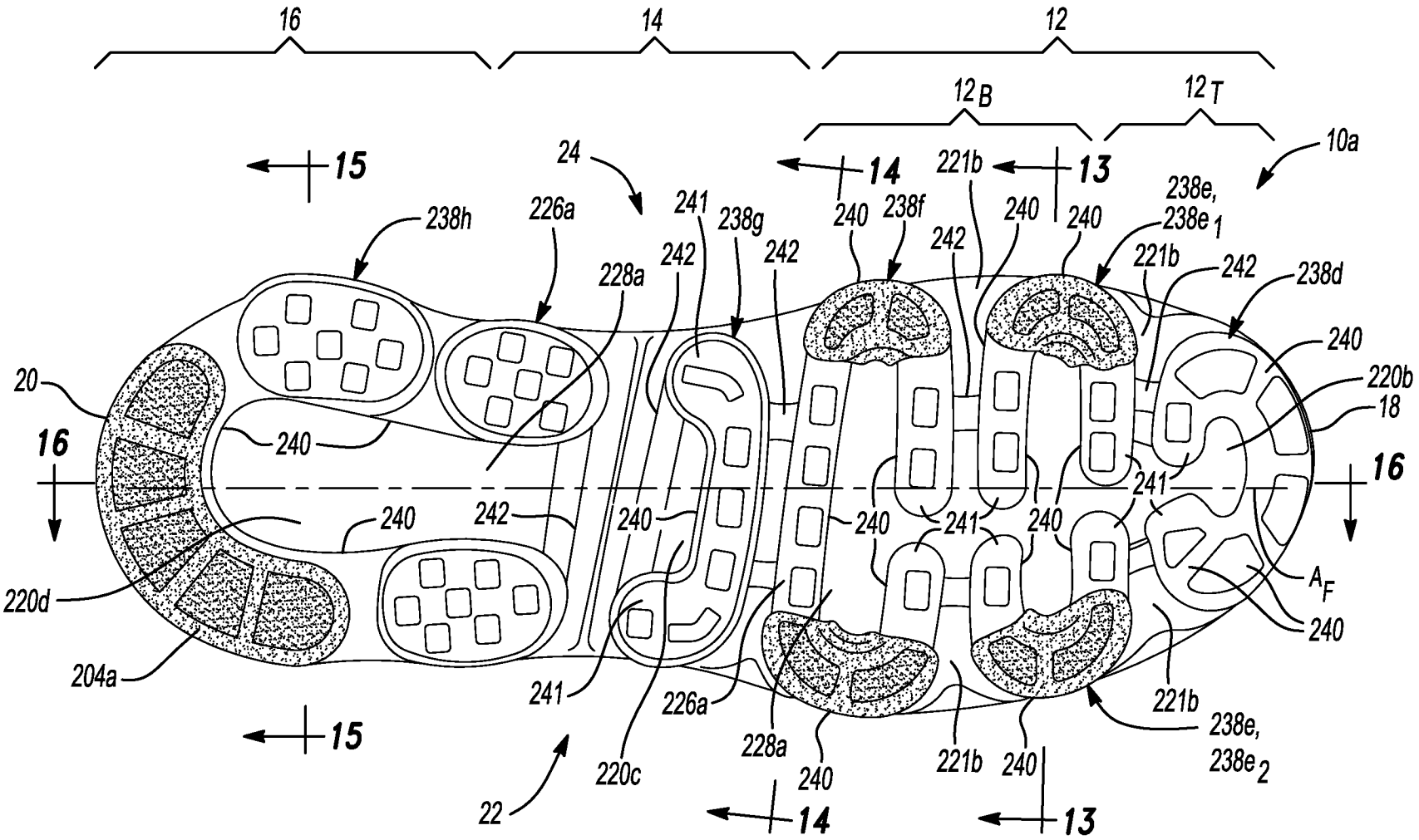
FIG. 12 is a bottom plan view of the sole structure of FIG. 11A, showing a plurality of segments and a web area of the bladder.
Figure 13:
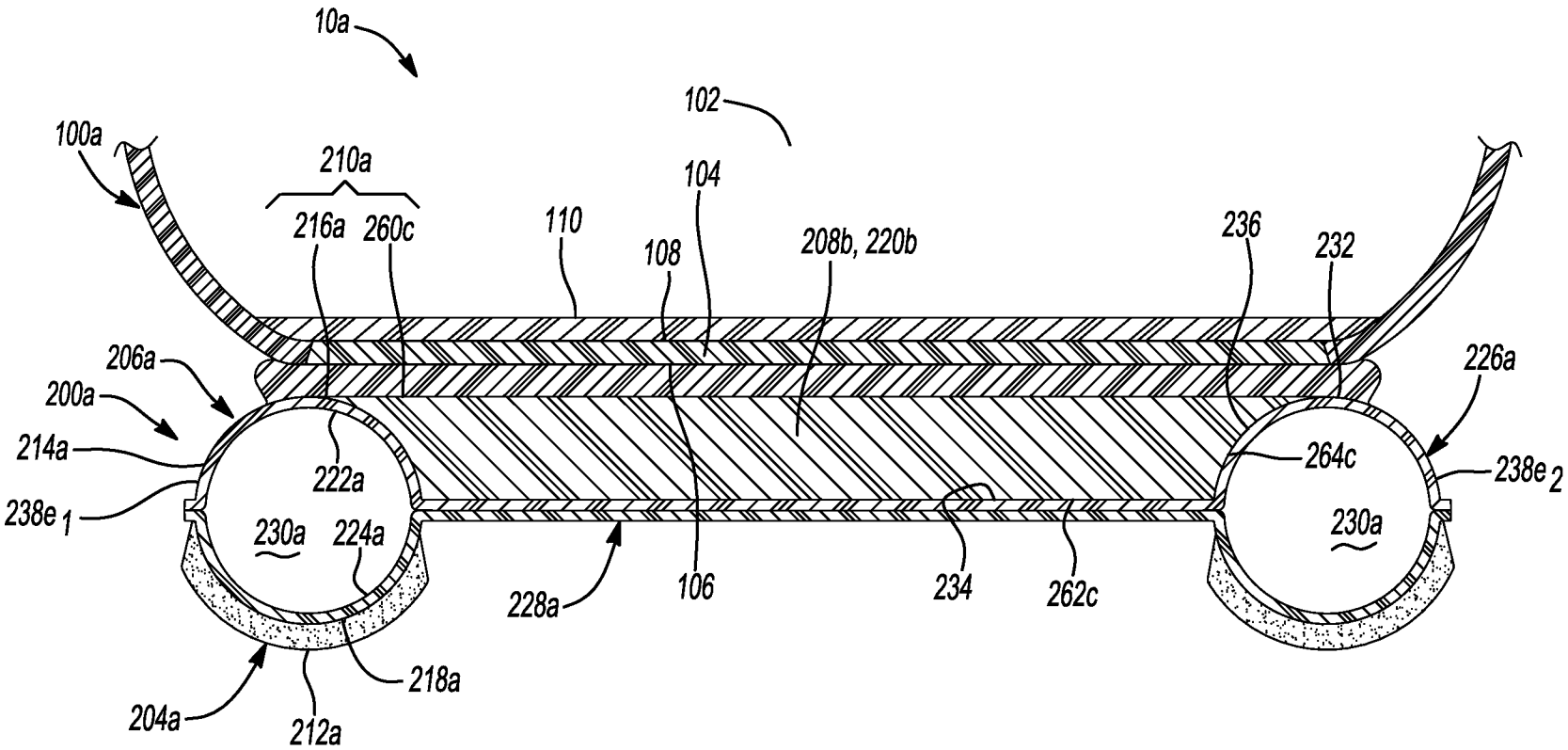
FIG. 13 is a cross-sectional view taken along line 13-13 of FIG. 12, showing segments disposed within a forefoot region of the sole structure and separated from one another by a web area.
Figure 14:
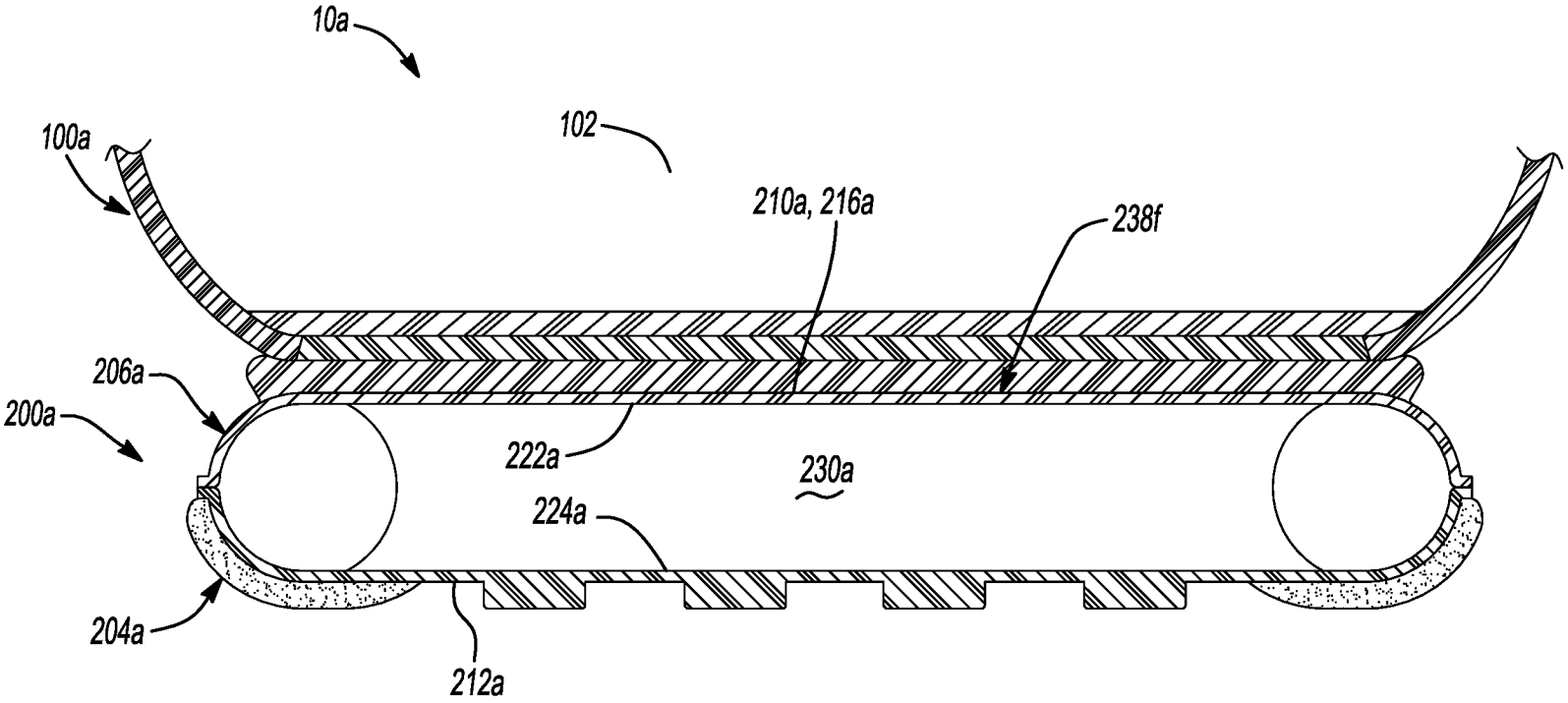
FIG. 14 is a cross-sectional view taken along line 14-14 of FIG. 12, showing segments disposed within a forefoot region of the sole structure and separated from one another by a web area.
Figure 15:
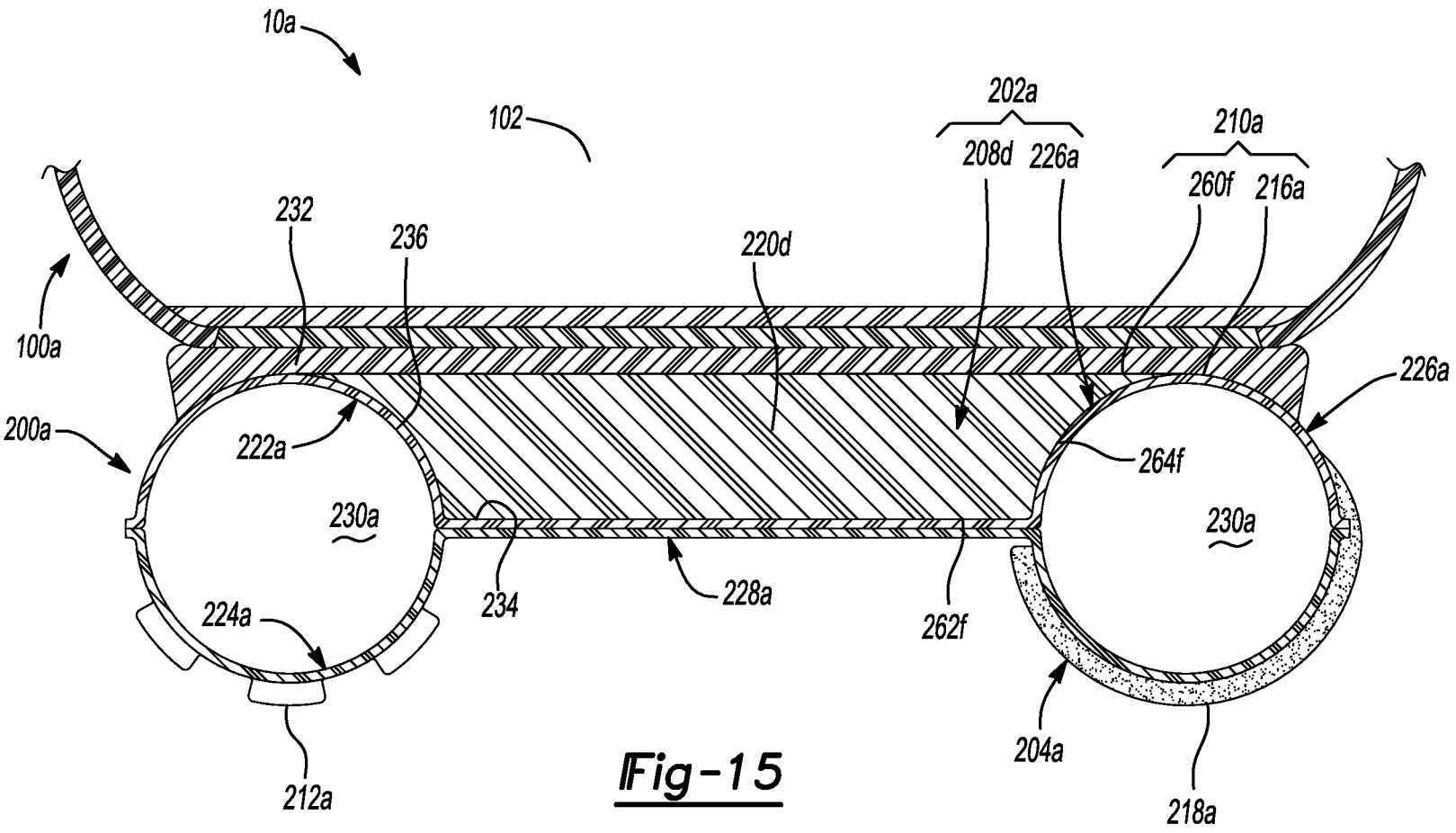
FIG. 15 is a cross-sectional view taken along line 15-15 of FIG. 12, showing segments disposed within a heel region of the sole structure and separated from one another by a web area.
Figure 16:
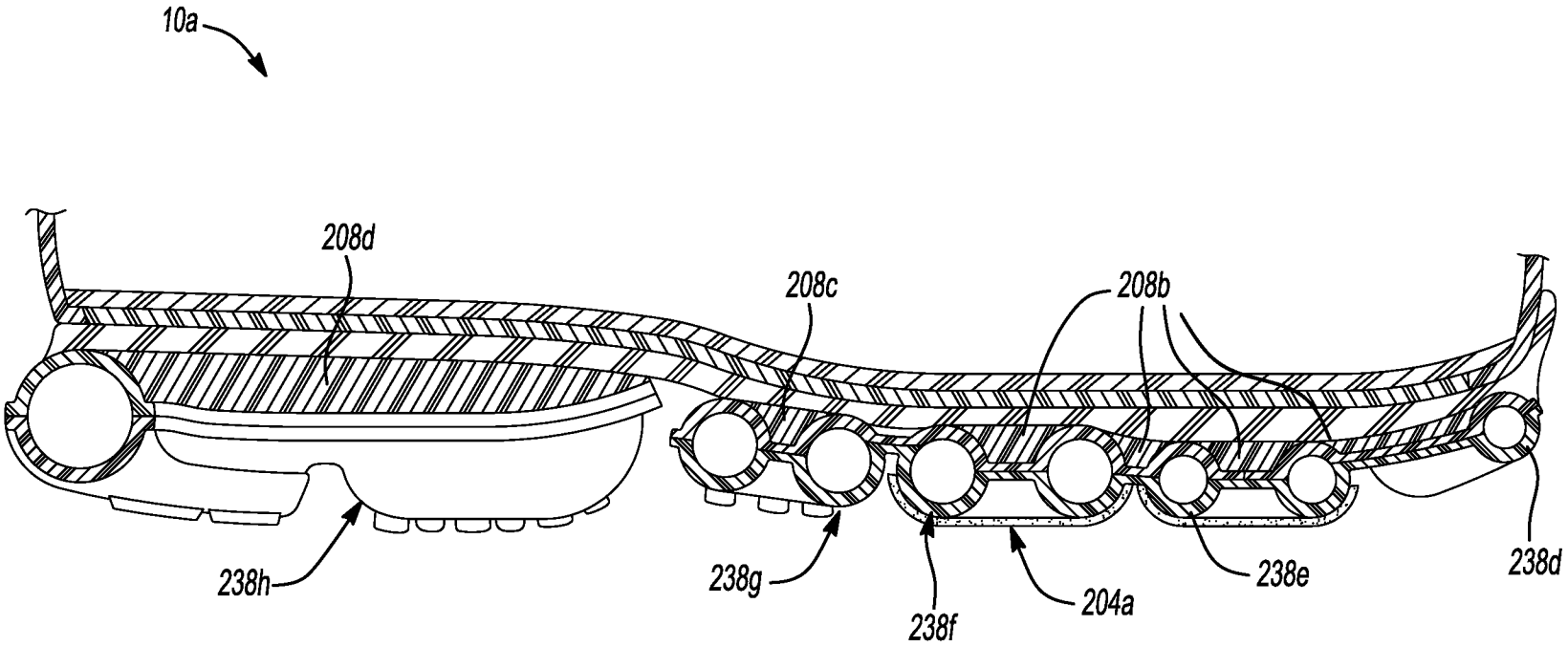
FIG. 16 is a cross-sectional view taken along line 16-16 of FIG. 12, showing segments arranged along a forefoot region, a mid-foot region, and a heel region.

As best shown in FIG. 12, the chamber 226*a* may be described as including a plurality of sub-chambers 238*d*-238*h* each comprising a plurality segments 240 that are at least partially spaced apart from each other by the web area 228*a* and cooperate to define a profile of the ground-engaging surface 30 of the footwear 10*a*. The segments 240 of each sub-chamber 238*d*-238*g* are in direct fluid communication with each other. Further, a series of the segments 240 are arranged sequentially with each other along a length of the chamber 226*a*, as shown in FIG. 12. The chamber 226*a* may further include one or more conduits 242 configured to provide fluid communication between the sub-chambers 238*d*-238*h*. In some examples, two or more of the sub-chambers 238*d*-238*h* may be in fluid communication via one or more conduits 242.

Each of the segments 240 and the conduits 242 may be filled with a pressurized fluid (i.e., gas, liquid) to provide cushioning and stability for the foot during use of the footwear 10*a*. In some implementations, compressibility of a first portion of the plurality of segments 240 of the sub-chambers 238*d*-238*h* under an applied load provides a responsive-type cushioning, while a second portion of the segments 240 of the sub-chambers 238*d*-238*h* may be configured to provide a soft-type cushioning under an applied load. Accordingly, the sub-chambers 238*d*-238*h* may cooperate to provide gradient cushioning to the article of footwear 10*a* that changes as the applied load changes (i.e., the greater the load, the more the segments 240 are compressed and, thus, the more responsive the footwear 10*a* performs).

In other implementations, one or more cushioning materials (none shown), such as polymer foam and/or particulate matter, are enclosed by one or more of the segments 240 in place of, or in addition to, the pressurized fluid to provide cushioning for the foot. In these implementations, the cushioning materials may provide one or more of the segments 240 with cushioning properties different from the segments 240 filled with the pressurized fluid. For example, the cushioning materials may be more or less responsive or provide greater impact absorption than the pressurized fluid.

As described in greater detail below, the chamber 226*a* may comprise a continuous network of fluidly connected sub-chambers 238*d*-238*h*, whereby a change in pressure in a first one of the sub-chambers 238*d*-238*h* is transmitted to a second one of the sub-chambers 238*d*-238*h*. Alternatively, one or more of the sub-chambers 238*d*-238*h* may be fluidly isolated from others of the sub-chambers 238*d*-238*h*. With continued reference to FIG. 12, the chamber 226*a* includes a toe sub-chamber 238*d*, an anterior ball sub-chamber 238*e*, a posterior ball sub-chamber 238*f* (collectively "the forefoot sub-chambers 238*d*-238*f*"), a mid-foot sub-chamber 238*g*, and a heel sub-chamber 238*h*. The forefoot sub-chambers 238*d*-238*f* and the mid-foot sub-chamber 238*g* are fluidly connected to each other via the conduits 242, while the heel sub-chamber 238*h* is fluidly isolated.

The toe sub-chamber 238*d* is disposed adjacent to the anterior end 18 of the sole structure 200*a* and defines a first portion of the forefoot recess 220*b*. The toe sub-chamber 238*d* includes a plurality of the segments 240 sequentially connected in a C-shaped arrangement, whereby a first one of the segments 240 extends continuously along the anterior end 18 of the sole structure 200*a* from the lateral side 22 to the medial side 24, and a pair of segments 240 extend towards each other from opposite ends of the first one of the segments 240, such that opposing terminal ends 241 of the segments 240 are spaced apart from each other by the web area 228*a*.

The anterior ball sub-chamber 238*e* may be described as including a medial portion 238$e_1$ and a lateral portion 238$e_2$ that are spaced apart from each other by the web area 228*a*. Here, the medial and lateral portions 238$e_1$, 238$e_2$ of the anterior ball sub-chamber 238*e* cooperate to define a second portion of the forefoot recess 220*b*. The lateral portion 238$e_2$ of the anterior ball sub-chamber 238*e* includes a first pair of laterally extending segments 240 connected to each other along the lateral side 22 by a longitudinally extending segment 240, whereby each of the laterally extending segments 240 of the anterior ball sub-chamber 238*e* extend towards the medial side 24 to terminal ends 241 in the interior region 28 of the midsole 202*a*. Conversely, the medial portion 238$e_1$ of the anterior ball sub-chamber 238*e* includes a second pair of laterally extending segments 240 connected to each other along the medial side 24 by a longitudinally extending one of the segments 240, whereby each of the laterally extending segments 240 of the medial portion 238$e_1$ of the anterior ball sub-chamber 238*e* extend towards the lateral side 22 to terminal ends 241 in the interior region 28 of the midsole 202*a*. The terminal ends 241 of the lateral portion 238$e_2$ of the anterior ball sub-chamber 238*e* are spaced apart from the terminal ends 241 of the medial portion 238$e_1$ of the anterior ball sub-chamber 238*e* by the web area 228*a*.

The posterior ball sub-chamber 238*f* is disposed adjacent to the anterior ball sub-chamber 238*e*, and defines a third portion of the forefoot recess 220*b*. As shown, the posterior ball sub-chamber 238*f* includes a first laterally extending segment 240 extending continuously from the lateral side 22 to the medial side 24, and an opposing pair of laterally extending segments 240 extending from each of the lateral side 22 and the medial side 24 to respective terminal ends 241 in the interior region 28. As shown, the terminal ends of the segments 240 oppose each other and are spaced apart from each other by the web area 228*a*. The laterally extending segments 240 are connected to each other along each of the lateral side 22 and the medial side 24, such that the posterior ball sub-chamber 238*f* forms a substantially C-shaped sub-chamber extending continuously from the first terminal end 241 to the second terminal end 241.

The mid-foot chamber 238*g* is disposed in the mid-foot region 14, adjacent to the posterior ball sub-chamber 238*f*, and defines a peripheral profile of the mid-foot recess 220*c*. As shown, the mid-foot chamber 238*g* includes a laterally extending segment 240 extending continuously from the lateral side 22 to the medial side 24 and including respective bulb-shaped terminal ends 241. The bulb-shaped terminal ends 241 of the mid-foot recess 220*c* may be connected to each other across the width of the bladder 206*a* by a conduit 242.

Referring still to FIG. 11B, the heel sub-chamber 238*h* defines a peripheral profile of the heel recess 220*d*. As shown, the heel sub-chamber 238*h* includes a posterior segment 240 extending around the posterior end 20 of the sole structure 200*a* from the lateral side 22 to the medial side 24, a first longitudinally extending segment 240 extending along the lateral side 22 of the heel region 16 from the posterior segment 240 to a terminal end, and a second longitudinally extending segment 240 extending along the medial side 24 of the heel region 16 from the posterior segment 240 to a second terminal end. Accordingly, the heel chamber 238*h* has a substantially horseshoe or U-shaped profile, and defines an elongate recess 220*d* extending from the posterior segment 240 to the mid-foot region 14.

As discussed above, the recesses 220*b*-220*d* may be formed between bulges in the upper surface 216*a*, which are created when the interior void 230*a* of the chamber 226*a* is filled and the upper barrier layer 222*a* is biased apart from the lower barrier layer 224*a*. Accordingly, the profiles of the recesses 220*b*-220*d* formed in the upper surface 216 correspond to the arrangement of the sub-chambers 238*d*-238*h*, segments 240, and/or conduits 242. In the example of the bladder 206*a* shown in FIG. 11B, the chamber 226*a* forms a forefoot recess 220*b*, a mid-foot recess 220*c*, and a heel recess 220*d*.

As best shown in FIG. 11B, a peripheral profile of the forefoot recess 220*b* is collectively defined by the forefoot sub-chambers 238*d*-238*f* As shown in FIG. 12, each of the forefoot sub-chambers 238*d*-238*f* includes a plurality of segments 240 arranged in a substantially obround or oval shape, whereby the portions of the forefoot recess 220*b* surrounded by the forefoot sub-chambers 238*d*-238*f* have an outer peripheral profile that is substantially obround or oval shaped and includes a major axis extending in a lateral direction from the lateral side 22 to the medial side 24, transverse to the longitudinal axis $A_F$ of the footwear 10.

As discussed above, each of the forefoot sub-chambers 238*d*-238*f* has segments 240 that extend to terminal ends 241 in the interior region 28, whereby the web area 228*a* extends between the terminal ends 241 of the segments 240. Accordingly, the forefoot recess 220*b* is continuously formed from the toe sub-chamber 238*d* to the posterior ball sub-chamber 238*f*, whereby the portions of the forefoot recess 220*b* surrounded by the respective forefoot sub-chambers 238*d*-238*f* are connected to each other by the portions of the forefoot recess 220*b* extending between the terminal ends 241. The forefoot recess 220*b* may also include wing portions 221*b* that extend between adjacent ones of the forefoot sub-chambers 238*d*-238*f* In some examples, the conduits 242 that connect each of the forefoot sub-chambers 238*d*-238*f* may form bulges along the inner portion 234 of the forefoot recess 220*b*. The bulges corresponding to the conduits 242 may have a height that is less than the heights of the forefoot sub-chambers 238*d*-238*f* Regardless, the forefoot recess 220*b* is continuous across the conduits 242.

Referring still to FIG. 11B, the mid-foot recess 220*c* is defined by the cooperation of the mid-foot sub-chamber 238*g* and the conduit 242 extending between the bulb-shaped terminal ends 241 of the mid-foot sub-chamber 238*g*. As shown in FIG. 12, the segments 240 of the mid-foot sub-chamber 238*g* and the conduit 242 are arranged in a substantially obround or oval shape and the mid-foot recess 220*c* has outer peripheral profile that is substantially obround or oval shaped and includes a major axis extending in a lateral direction from the lateral side 22 to the medial side 24, transverse to the longitudinal axis $A_F$ of the footwear 10.

A peripheral profile of the heel recess 220*d* is defined by the heel sub-chamber 238*h*. As shown, the heel recess 220*d* is continuously formed through the heel region 16, and extends from the posterior segment 240 of the heel sub-chamber 238*h* to the mid-foot region 14.

With continued reference to FIGS. 11A and 11B, the illustrated example of the sole structure 200*a* includes a plurality of foam inserts 208*b*-208*d* associated with respective ones of the recesses 220*b*-220*d*. Particularly, the footwear 10*a* includes a forefoot insert 208*b* received within the forefoot recess 220*b*, a mid-foot insert 208*c* received within the mid-foot recess 220*c*, and a heel insert 208*d* received within the heel recess 220*d*. Each of the inserts 208*b*-208*d* includes a top surface 260*b*-260*d* and a bottom surface 262*b*-262*d* formed on an opposite side of the foam insert 208*b*-208*d* from the top surface 260*b*-260*d*. A peripheral side surface 264*b*-264*d* of each of the inserts 208*b*-208*d* extends from the top surface 260*b*-260*d* to the bottom surface 262*b*-262*d*.

Generally, each of the foam inserts 208*b*-208*d* is configured to be received within and substantially fill a respective one of the recesses 220*b*-220*d*. As described above, the top surfaces 260*b*-260*d* of the foam inserts 208*b*-208*d* may cooperate with the outer portion 232 of the upper surface 216*a* of the bladder 206*a* to form the top surface 210*a* of the midsole 202*a*, which may be contoured to accommodate a profile of a plantar surface of a foot. Accordingly, the foam inserts 208*b*-208*d* may be formed such that the top surfaces 260*b*-260*d* merge with the outer portion 232 of the bladder 206*a* in a substantially tangential relationship, thereby forming a continuous and flush top surface 210*a* of the midsole 202*a*. As shown in FIG. 11A, when the foam inserts 208*b*-208*d* are assembled within the recesses 220*b*-220*d*, the outer portion 232 of the upper surface 216*a* of the bladder 206*a* will be exposed between the foam inserts 208*b*-208*d*.

With reference to the cross-sectional views of FIGS. 13-16, the foam inserts 208*b*-208*d* are configured to fill the recesses 220*b*-220*d* to form a substantially continuous and flush top surface 210*a* of the midsole 202*a*. Accordingly, the bottom surfaces 262, 262*a* of the foam inserts 208*b*-208*d* are configured to oppose or interface with the inner portion 234 of the upper surface 216*a*, while the peripheral side surfaces 264, 264*a* are configured to cooperate with the peripheral portion 236 of the upper surface 216*a*. Accordingly, where the web area 228*a* is substantially planar, the bottom surfaces 262*b*-262*d* of the foam inserts 208*b*-208*d* will also be substantially planar. However, where the inner portion 234 includes bulges (e.g., where the conduits are formed in the forefoot recess 220*b*) or depressions, the bottom surfaces 262*b*-262*d* of the inserts 208*b*-208*d* may include corresponding recesses 266 (see FIG. 11B) configured to receive the conduits 242, and/or protuberances configured to be matingly received within the depressions. Likewise, where the peripheral portion 236 has a convex profile, the peripheral side surfaces 264*b*-264*d* of the insert 208*b*-208*d* will have a concave profile configured to receive the peripheral portion 236 of the upper surface 216*a*, as shown in FIGS. 13-16.

In use, the examples of the sole structures 200, 200*a* described above provide improved comfort to the plantar surface of a foot of a wearer by minimizing localized forces that may be imparted by the bladder 206, 206*a* of the sole structure 200, 200*a*. Particularly, by including foam inserts 208-208*d* on the upper surface 216, 216*a* of the bladder 206, 206*a*, between the chamber 226, 226*a*, forces imparted to the plantar surface of the foot by the chamber 226, 226*a* may be more evenly distributed along the entire plantar surface of the foot. Simultaneously, the aforementioned concept allows the overall weight of the sole structure 200, 200*b* to be minimized by implementing discrete foam inserts 208-208*d* in recesses 220-220*d* formed between bulged portions of the chamber 226. Whereas conventional sole structures may include additional cushioning layers extending over top of the chamber 226, 226*a*, the sole structure 200, 200*a* of the instant disclosure only utilizes localized inserts 208-208*d*. Accordingly, the amount of foam used in the sole structure

200, 200*a* is minimized, thereby minimizing overall weight of the sole structure while providing a more comfortable footbed.

The following Clauses provide an exemplary configuration for an article of footwear described above.

Clause 1: A sole structure for an article of footwear, the sole structure comprising a bladder including an upper surface having a first portion defining a chamber and a second portion defining at least one recess adjacent to the chamber and at least one foam insert disposed within the at least one recess and having a top surface that is substantially flush with the first portion of the upper surface of the bladder, the first portion of the upper surface being exposed adjacent to the at least one foam insert.

Clause 2: The sole structure of Clause 1, wherein the at least one foam insert is disposed between a first portion of the chamber and a second portion of the chamber.

Clause 3: The sole structure of Clause 1, wherein the bladder includes an upper barrier layer and a lower barrier layer attached to the upper barrier layer to form a web area between segments of the chamber.

Clause 4: The sole structure of Clause 3, wherein the web area defines the second portion of the upper surface.

Clause 5: The sole structure of Clause 1, wherein the at least one foam insert includes a first segment and a second segment and the upper surface of the bladder is exposed between the first segment and the second segment.

Clause 6: The sole structure of Clause 1, wherein the at least one foam insert substantially fills the at least one recess.

Clause 7: The sole structure of Clause 1, wherein the top surface of the at least one foam insert is tangent with the first portion of the chamber.

Clause 8: The sole structure of Clause 1, wherein the chamber is a fluid-filled chamber.

Clause 9: The sole structure of Clause 1, wherein the bladder includes a first recess in a heel region and a second recess in a forefoot region, the at least one foam insert including a first foam insert disposed within the first recess and a second foam insert disposed within the second recess.

Clause 10: The sole structure of Clause 9, wherein the first portion of the bladder, a top surface of the first foam insert, and a top surface of the second foam insert are substantially flush.

Clause 11: A sole structure for an article of footwear, the sole structure comprising a bladder including a chamber and a plurality of recesses formed in an upper surface of the bladder, the plurality of recesses having peripheral profiles defined by the chamber and a plurality of foam inserts each disposed within respective ones of the plurality of the recesses and including top surfaces that are substantially flush with the upper surface of the bladder to form a substantially continuous top surface of the sole structure.

Clause 12: The sole structure of Clause 11, wherein each of the plurality of the foam inserts is at least partially surrounded by the chamber.

Clause 13: The sole structure of Clause 11, wherein the bladder includes an upper barrier layer and a lower barrier layer attached to the upper barrier layer to form a web area between segments of the chamber.

Clause 14: The sole structure of Clause 13, wherein the web area defines the plurality of the recesses.

Clause 15: The sole structure of Clause 11, wherein the upper surface of the bladder is exposed between the plurality of the foam inserts.

Clause 16: The sole structure of Clause 11, wherein the plurality of the foam inserts substantially fill the plurality of the recesses.

Clause 17: The sole structure of Clause 11, wherein top surfaces of each of the plurality of the foam inserts are substantially flush with a portion of the upper surface corresponding to the chamber.

Clause 18: The sole structure of Clause 11, wherein the chamber is a fluid-filled chamber.

Clause 19: The sole structure of Clause 11, wherein the plurality of recesses includes a first recess in a heel region of the sole structure and a second recess in a forefoot region of the sole structure, the plurality of inserts including a first foam insert disposed within the first recess and a second foam insert disposed within the second recess.

Clause 20: The sole structure of Clause 19, wherein the plurality of recesses includes a third recess in a midfoot region of the sole structure, the plurality of foam inserts including a third foam insert disposed within the third recess.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A sole structure for an article of footwear, the sole structure comprising:

a bladder including an upper surface having a first portion defining a chamber and a second portion defining at least one recess adjacent to the chamber; and at least one foam insert disposed within the at least one recess and including a plurality of segments connected to each other, the plurality of segments including at least two elongate segments that each extend from a medial side of the sole structure to a lateral side of the sole structure to form a serpentine shape having a top surface that is flush with the first portion of the upper surface of the bladder, the first portion of the upper surface being exposed adjacent to the at least one foam insert.

2. The sole structure of claim 1, wherein the at least one foam insert is disposed between a first portion of the chamber and a second portion of the chamber.

3. The sole structure of claim 1, wherein the bladder includes an upper barrier layer and a lower barrier layer attached to the upper barrier layer to form a web area between segments of the chamber.

4. The sole structure of claim 3, wherein the web area defines the second portion of the upper surface.

5. The sole structure of claim 1, wherein the bladder is exposed between adjacent segments of the plurality of segments.

6. The sole structure of claim 1, wherein the at least one foam insert substantially fills the at least one recess.

7. The sole structure of claim 1, wherein the top surface of the at least one foam insert is tangent with the first portion of the upper surface of the bladder.

8. The sole structure of claim 1, wherein the chamber is a fluid-filled chamber.

9. The sole structure of claim 1, wherein the bladder includes a first recess in a heel region and a second recess in a forefoot region, the at least one foam insert including a first foam insert disposed within the first recess and a second foam insert disposed within the second recess.

10. The sole structure of claim 9, wherein the first portion of the bladder, a top surface of the first foam insert, and a top surface of the second foam insert are flush.

11. A sole structure for an article of footwear, the sole structure comprising:

a bladder including a chamber and a plurality of recesses formed in an upper surface of the bladder, the plurality of recesses having respective peripheral profiles defined by the chamber; and a plurality of foam inserts each disposed within respective ones of the plurality of the recesses and each including a top surface, a bottom surface, and a peripheral side surface connecting the top surface to the bottom surface, each of the top surfaces being flush with the upper surface of the bladder to form a continuous top surface of the sole structure and an entirety of the peripheral side surface of at least one foam insert of the plurality of foam inserts being in contact with the chamber of the bladder, at least one of the plurality of foam inserts including at least two elongate segments that extend from a medial side of the sole structure to a lateral side of the sole structure.

12. The sole structure of claim 11, wherein each of the plurality of foam inserts is at least partially surrounded by the chamber.

13. The sole structure of claim 11, wherein the bladder includes an upper barrier layer and a lower barrier layer attached to the upper barrier layer to form a web area between segments of the chamber.

14. The sole structure of claim 13, wherein the web area defines the plurality of the recesses.

15. The sole structure of claim 11, wherein the upper surface of the bladder is exposed between the plurality of foam inserts.

16. The sole structure of claim 11, wherein the plurality of foam inserts substantially fill the plurality of the recesses.

17. The sole structure of claim 11, wherein the chamber is a fluid-filled chamber.

18. The sole structure of claim 11, wherein the plurality of recesses includes a first recess in a heel region of the sole structure and a second recess in a forefoot region of the sole structure, the plurality of foam inserts including a first foam insert disposed within the first recess and a second foam insert disposed within the second recess.

19. The sole structure of claim 18, wherein the plurality of recesses includes a third recess in a midfoot region of the sole structure, the plurality of foam inserts including a third foam insert disposed within the third recess.

20. An article of footwear incorporating the sole structure of claim 11.

* * * * *